US005090351A

United States Patent [19]

Goldbach et al.

[11] Patent Number: 5,090,351

[45] Date of Patent: Feb. 25, 1992

[54] VESSEL HULL CONSTRUCTION AND METHOD

[75] Inventors: Richard A. Goldbach, Norfolk, Va.; Richard Salzer, Sugarland, Tex.; Frank E. McConnell, Norfolk, Va.

[73] Assignees: Metro Machine Corporation, Norfolk, Va.; Marinex International, Inc., Hoboken, N.J.

[21] Appl. No.: 678,802

[22] Filed: Apr. 1, 1991

[51] Int. Cl.[5] ..... B63B 3/02

[52] U.S. Cl. ..... 114/65 R; 114/88; 114/77 R

[58] Field of Search ..... 114/65 R, 77 R, 77 A, 114/78, 83, 85, 87, 88; 29/429

[56] References Cited

U.S. PATENT DOCUMENTS

| | | | |
|---|---|---|---|
| 3,011,252 | 12/1961 | Svensson | 29/429 |
| 3,447,503 | 6/1969 | Myers | 114/77 |
| 3,487,807 | 1/1970 | Van Der Hoeven | 114/77 |
| 3,656,680 | 4/1972 | Nomura | 228/44 |
| 3,698,344 | 10/1972 | Maeda | 114/77 R |
| 3,703,153 | 11/1972 | Maeda | 114/77 R |
| 3,704,822 | 12/1972 | Nomura | 228/25 |
| 3,753,413 | 8/1973 | Ichikawa et al. | 114/65 |
| 3,872,815 | 3/1975 | Kawai et al. | 114/65 R |
| 3,875,887 | 4/1975 | Fittrip et al. | 114/77 R |
| 3,886,883 | 6/1975 | Odaka | 114/65 R |
| 4,003,326 | 1/1977 | Horii et al. | 114/65 R |
| 4,267,789 | 5/1981 | Ivanov et al. | 114/65 R |
| 4,341,175 | 7/1982 | Ivanov | 114/65 R |
| 4,476,797 | 10/1984 | Ivanov et al. | 114/65 R |
| 4,491,081 | 1/1985 | Ivanov | 114/65 R |
| 4,548,154 | 10/1985 | Murata et al. | 114/355 |
| 4,573,422 | 3/1986 | Murata et al. | 114/65 |
| 4,638,754 | 1/1987 | Tornay | 114/79 R |
| 4,660,491 | 4/1987 | Murata et al. | 114/65 |
| 4,674,430 | 6/1987 | Murata et al. | 114/355 |
| 4,712,499 | 12/1987 | Haruguchi et al. | 114/65 R |

OTHER PUBLICATIONS

"Great Lakes Ore Transportation System" (Description of the Vessel and Construction Method Which the Former Erie Yard was Designed to Manufacture and Practice).

*Primary Examiner*—Jesus D. Sotelo
*Assistant Examiner*—Stephen P. Avila
*Attorney, Agent, or Firm*—Cushman, Darby & Cushman

[57] ABSTRACT

An improved curved-plate, double-hull tanker construction is provided, having reduced or eliminated transverse reinforcing structure in its midbody, except for bulkheads. The hull, though double, can compare in weight to conventional single hulls, despite being entirely made of mild steel plate. It is made of significantly fewer pieces, with a reduction in welding footage. More of the steel is used in the form of plate, rather than more expensive shapes. Improved productivity is possible, resulting from standardization of parts, less scrap, greater use of jigs and fixtures, automated welding, blast-cleaning and painting, so that not so much staging is needed, the work environment can be safer, and the product can be produced at a lower unit labor cost. Preferably, cathodic epoxy painting is used for durability and reduction in problems due to blast cleaning, solvent evaporation and generation of refuse. Extending the double hull structure from the bottom and sides of the hull to the main deck can provide space for fuel oil to be located safely away from the skin of the ship, rather than in possibly vulnerable deep tanks at the stern. The constructional technique is believed to be applicable to vessel hulls in the 70,000 DWT to 300,000 DWT range. The vessel hull midbody module subassemblies may be assembled into modules, hull midbodies and vessels using the method and apparatus disclosed in Cuneo et al., Application No. 07/532,329.

29 Claims, 40 Drawing Sheets

VESSEL HULL CONSTRUCTION AND METHOD

BACKGROUND OF THE INVENTION

In the co-pending application of Cuneo et al., Application No. 07/532,329, there is disclosed apparatus and a method for constructing a novel double-hulled product, which as panels, modules and midbodies, are useful in the construction of vessels, in particular, bulk carriers for crude oil and other products.

The present invention relates to improvements in the method and poducts disclosed in the above-identified, earlier application, the contents of which are incorporated herein by reference.

In general, the invention relates to providing a double-hulled vessel which, compared with conventional constructions, is made with a reduced number of different pieces, a reduced complexity, which can be fabricated using a higher degree of automation, which, in many applications is more durable and/or needs less maintenance, and need not cost the 20 percent additional that a conventional double hull costs compared with a conventional single hull. In fact, in some instances, a double hull produced in accordance with the invention can successfully compete in price with a conventional single hull for the same duty and carrying capacity.

Compared with the apparatus, method and products disclosed in the above-mentioned, earlier patent application of Cuneo et al., the present invention teaches a different method for forming the curved plates of the hull, for placing the stiffeners on the flat plates, for assembling the plates into product components for cleaning the plates prior to protectively coating the components of the product, and for protectively coating (i.e., "painting") the components.

As a result of a 1970's convention entered into by the major maritime shipping nations (the "MARPOL Convention"), bulk petroleum carrier ships must have separate tanks for ballast and cargo oil. Ships thereupon necessarily became larger in overall size for carrying the same amount of cargo. Fewer bulk petroleum carrier ships were built to this requirement than had been built to serve the same market within a comparable prior period. Also, new and aggressively expanding factors in the bulk cargo vessel field sought to capture market share by cutting out what they deemed excess weight in the construction of hulls for such vessels. Part of the reduction was accomplished by using high tensile strength steel, but some was accomplished by reducing the safety margin in the thickness, spacing and redundancy of constructional elements conventionally provided to accommodate loss of strength due to corrosion occurring during the expected life of the vessel. At the same time, carrying only ballast in certain tanks of the vessel, due to requirements of the MARPOL Convention, caused accelerated corrosion. The need for better coatings was not recognized soon enough; therefore, it is now believed that many bulk cargo-carrying ships built within the last 15 years will have unpredictably short useful lives.

A conventional double-hull tanker lets ballast be carried between hulls. Such a ship does not need to be any larger, overall, than a conventional single-hull, segregated-ballast tanker.

It is conventional to blast-clean and coat the surfaces of ballast tanks upon construction, and thereafter, once each 5 years. Currently, sand or mineral abrasive is used for the abrasive in blast cleaning the tank surfaces, and solvent-based paints are used for originally coating, and recoating them.

Although several coatings manufacturers are believed to be experimenting with water-based, marine paints, it is problematical whether and when such paints will become commercially available and displace solvent-based paints from the marketplace.

Workers at shipyards are becoming less willing to work in a confined space with sand-blasting equipment and with apparatus for applying solvent-based paints.

Coating a vessel results in the generation of refuse, such as empty paint drums, which often must be disposed of as hazardous waste. A painting system which uses less paint (e.g., only about 20 percent as much paint as conventional), potentially reduces the bulk of refuse needing to be disposed of as hazardous waste.

Recent changes to air quality legislation (the Clean Air Act), give certain industrial users no more than 10 years to solve problems of air quality resulting from paint overspray, and release of volatile organic compounds into the air, as solvents evaporate from coatings.

Accordingly, there is a present need in the marketplace, both from an environmental standpoint and from a work force contentedness standpoint of a painting system which provides a longer lasting coating in the specific environment.

Good coating requires cleaning of the surface that is to be coated immediately prior to applying the coating thereto. However, if a coating is applied to components early in a fabrication process, portions of it may be destroyed later by welding and cutting of structure and temporary fitting and holding devices used in the course of constructing a hull.

There is a trend in industrial coatings, particularly in consumer products, towards greater use of cathodic application of epoxy material. Certain cathodic epoxy paints are known to have the capability of providing good protection against both oil and salt water. A conventional marine coating typically survives 400 to 500 hours in a salt spray (accelerated corrosion) test, whereas cathodic epoxy coatings, particularly which recently have become commercially available from PPG Coatings, can survive 2000 hours in the salt spray test. In applying such a coating, the part is shot-blasted, then cleaned, finished and provided corrosion protection through a chemical wash and pretreatment process of three stages or more, and then dipped into a bath of paint particles and water, with the part serving as a cathode causing the paint particles to "plate" onto its surfaces. The coated part is then dried using infrared energy sources at approximately 350° F. Usually, this dip-and-dry process is repeated one or more times, after which the coated part is inspected for integrity of the coating. Parts which pass are considered completed; those which do not, are recycled for remedial coating. This process is believed to be presently in commercial use for coating outboard motors for boats.

Conventionally, fuel oil for powering hhe engines which propel a tanker is stored in deep tanks at the ends of the vessel. In these locations, the vessel fuel oil sometimes is located where it could easily spill, were the vessel hull to become ruptured in an accident. Accordingly, there is a need for a hull construction system which potentially can provide for storage of vessel fuel oil within closed bays of a double deck, remote from the danger of tank rupture and oil spillage.

It is believed that in the period from 1990 to 2010, the number of tankers requiring replacement or remidbodying, assuming modest expansion of world fleet requirements, an average vessel life of 25 years, and an average vessel size of 85,000 DWT, is about 180 to 200 tankers per year.

SUMMARY OF THE INVENTION

An improved curved-plate, double-hull tanker construction is provided, having reduced or eliminated transverse reinforcing structure in its midbody, except for bulkheads. The hull, though double, can compare in weight to conventional single hulls, despite being entirely made of mild steel plate. It is made of significantly fewer pieces, with a reduction in welding footage. More of the steel is used in the form of plate, rather than more expensive shapes. Improved productivity is possible, resulting from standardization of parts, less scrap, greater use of jigs and fixtures, automated welding, blast-cleaning and painting, so that not so much staging is needed, the work environment can be safer, and the product can be produced at a lower unit labor cost. Preferably, cathodicepoxy painting is used for durability and reduction in problems due to blast cleaning, solvent evaporation and generation of refuse. Extending the double-hull structure from the bottom and sides of the hull to the main deck can provide space for fuel oil to be located safely away from the skin of the ship, rather than in possibly vulnerable deep tanks at the stern. The constructional technique is believed to be applicable to vessel hulls in the 70,000 DWT to 300,000 DWT range. The vessel hull midbody module subassemblies may be assembled into modules, hull midbodies and vessels using the method and apparatus disclosed in Cuneo et al., Application No. 07/532,329.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 35 1s a fragmentary vertical longitudinal sectional view of the module of FIGS. 33 and 34, showing a typical shape and position for a transverse bulkhead;

DETAILED DESCRIPTION

Figure 1:
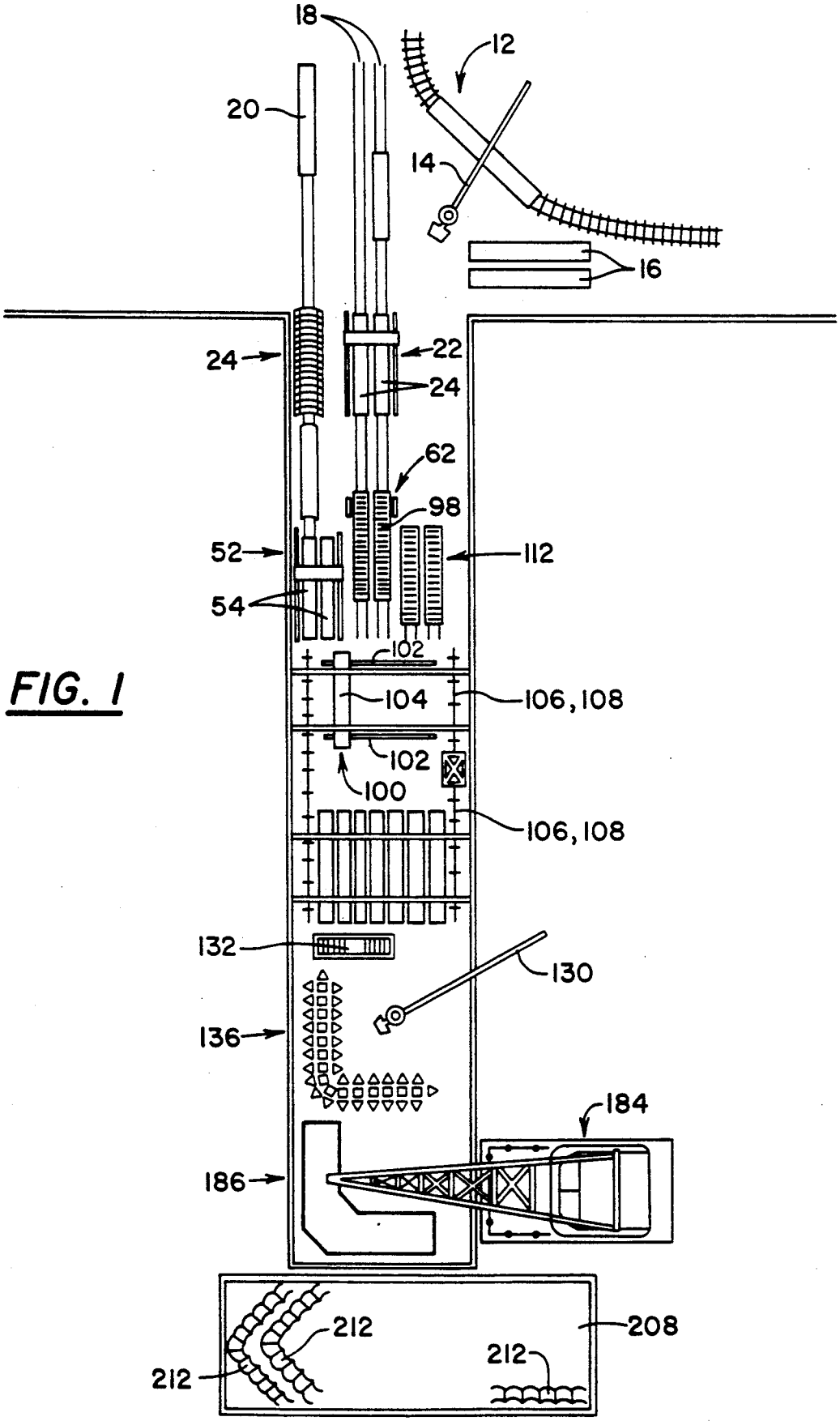
FIG. 1 is a fragmentary schematic top plan view of a facility for fabricating steel plate into subassemblies of modules for double-hull, bulk-carrier (e.g., VLCC) vessel hull midbodies, according to principles of the present invention.

Referring first to FIG. 1, a facility for transforming steel sheets into subassemblies for modules for double-hulled longitudinal midbodies of bulk cargo carriers is shown at 10.

Figure 2:
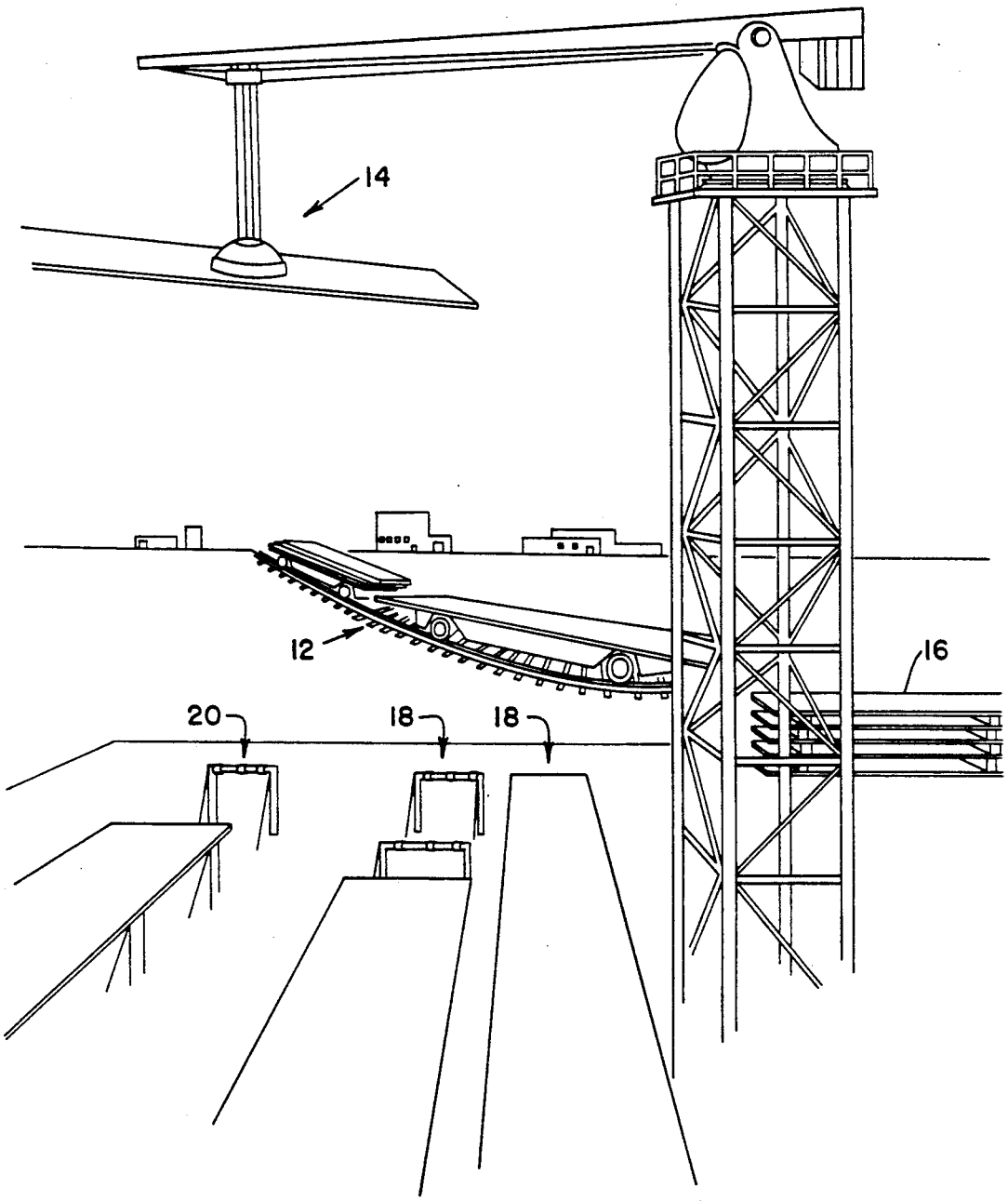
FIG. 2 is a fragmentary pictorial perspective view of a station on the line shown in FIG. 1, for offloading incoming steel plate from rail cars onto the line, or into storage.

Raw steel plate, typically 0.5 to 1.25 inch thick and approximately 8 feet wide and 50 feet long, procured from a steel mill, is received by rail car 12 (FIGS. 1 and 2), lifted off by an electromagnet-type grasping device-equipped crane 14 and placed either in storage 16, on one of two conveyor lines 18 feeding flat panel fabrication, on a rail car with an installed conveyor called a collocator car (not shown), or on a conveyor line 20 feeding curved panel fabrication.

Figure 3:
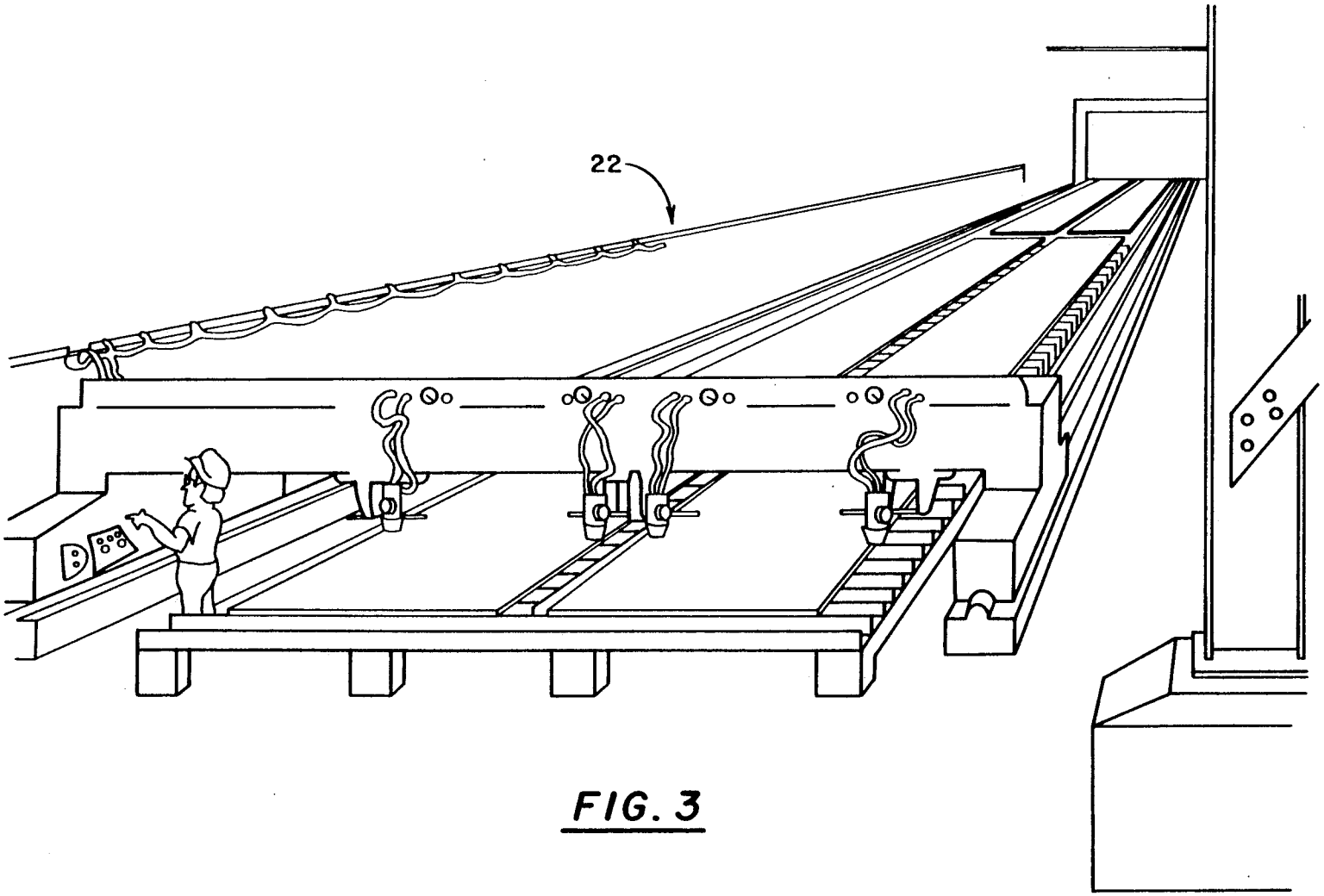
FIG. 3 is a fragmentary pictorial perspective view of apparatus on the line for flame cutting the steel plate into pieces of required configuration for use in fabricating the double-hull module subassemblies.

Raw steel plate destined for stiffened flat panels is conveyed on the lines 18 to an automatic burning machine 22 (FIGS. 1, 3 and 4) where it is cut to final configuration, including any lightening holes (not shown, but see the Cuneo et al. application) to provide flat steel plates 24.

Figure 5:
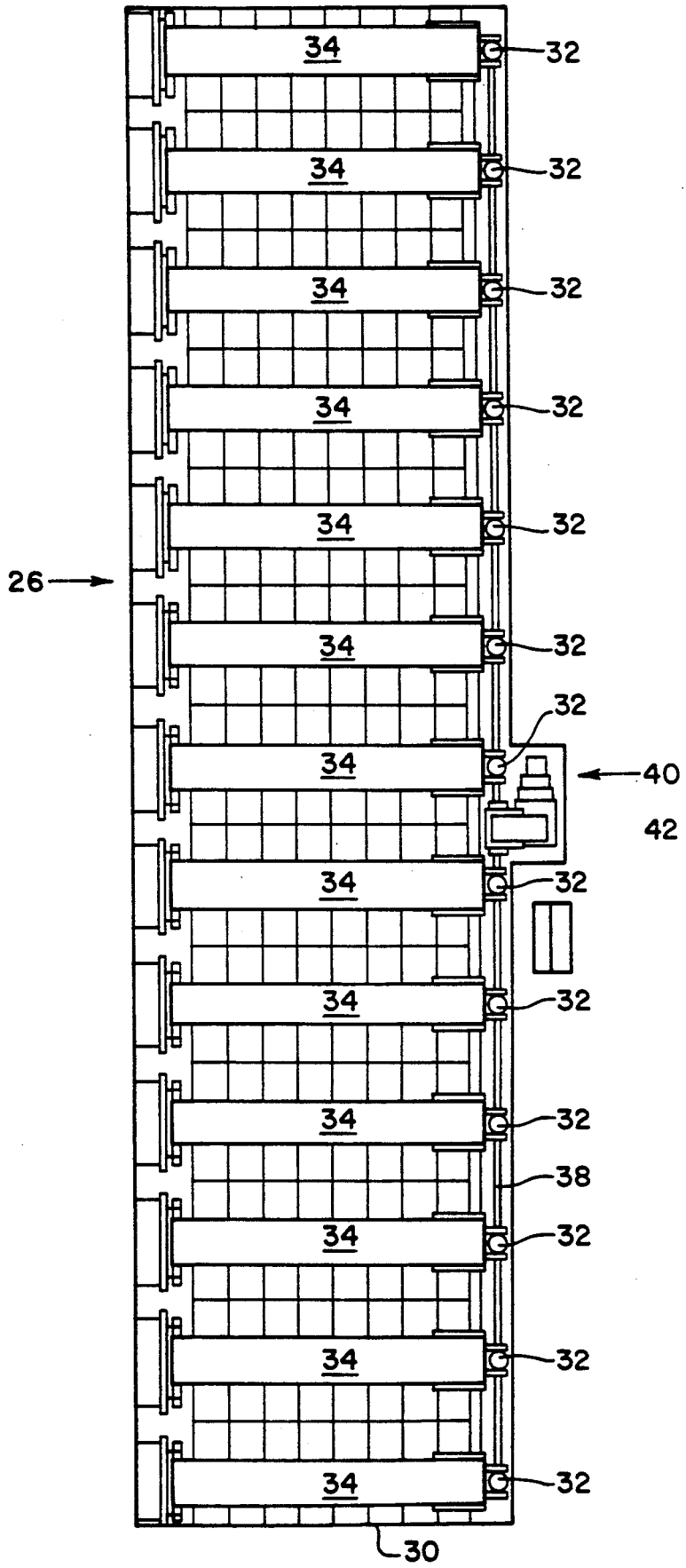
FIG. 5 is a schematic top plan view of a press assembly for producing the curved plates.
Figures 6, 7:
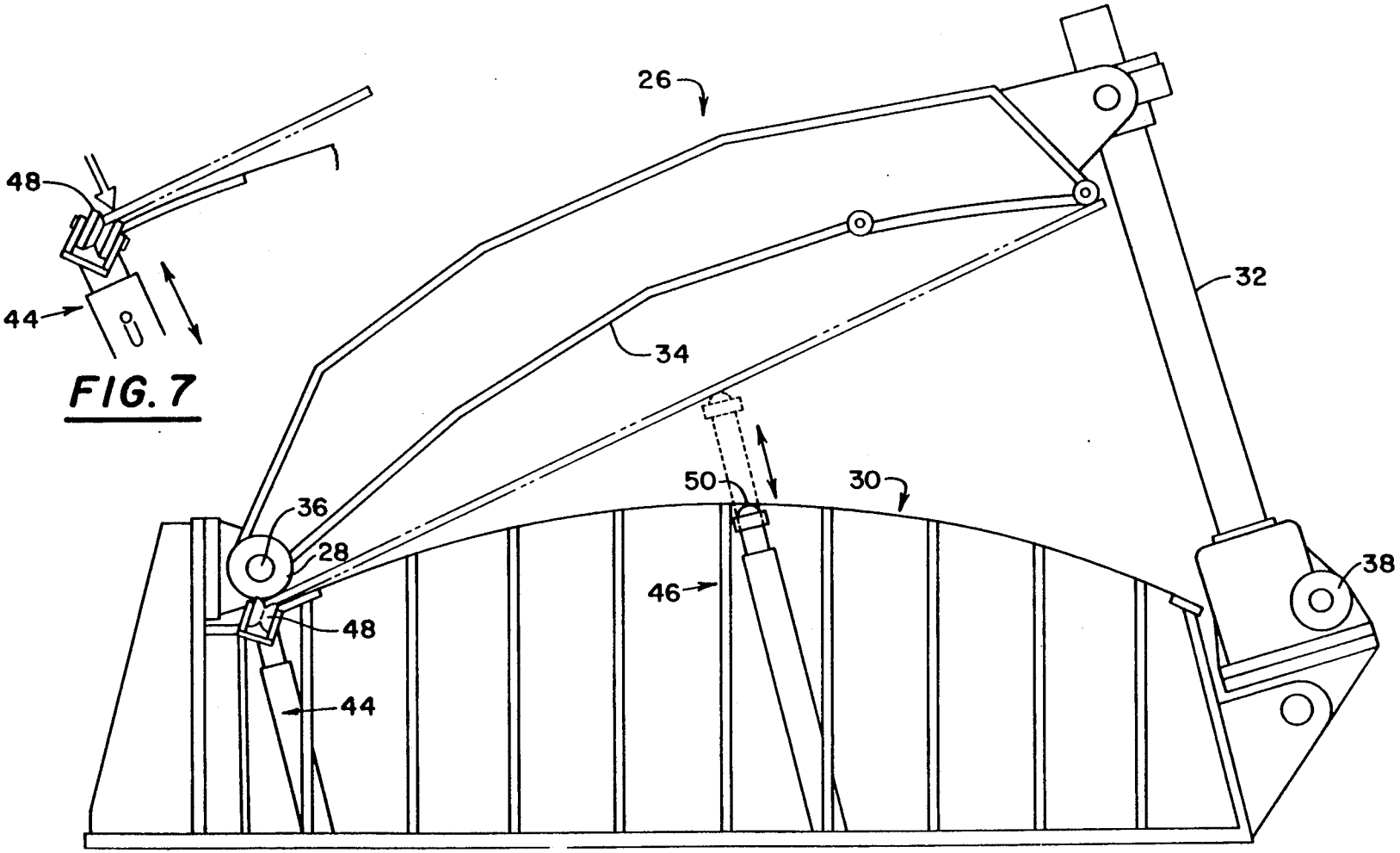
FIG. 6 is an end view of the press assembly of FIG. 5, showing the assembly about to be closed on a piece of plate stock for press-forming a curved panel therefrom.
FIG. 7 is an enlarged scale end view of a portion of the press assembly of FIG. 6, showing a retractable means for conveying an edge of the plate stock at the hinge side of the press assembly.
Figure 8:
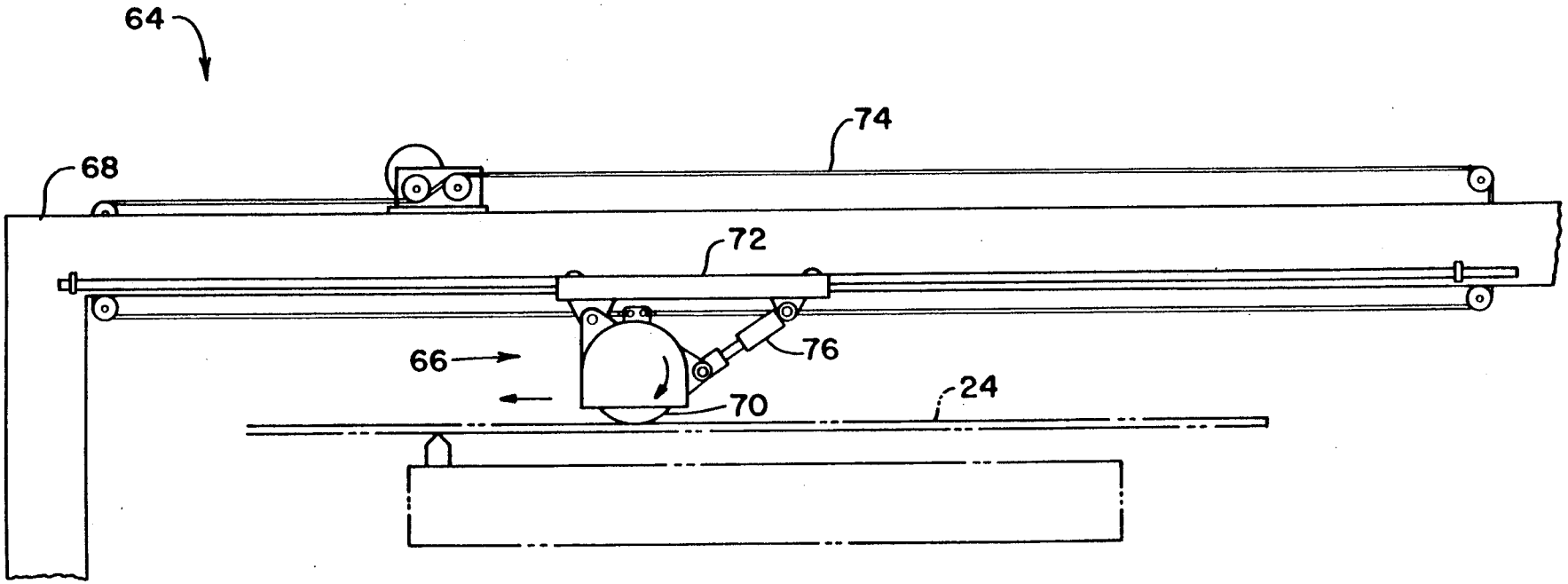
FIG. 8 is a front elevation view of a station for surface preparation of flat panel by grinding a succession of clean stripes on a surface so that respective stiffeners can be placed thereon and welded thereto.
Figure 9:
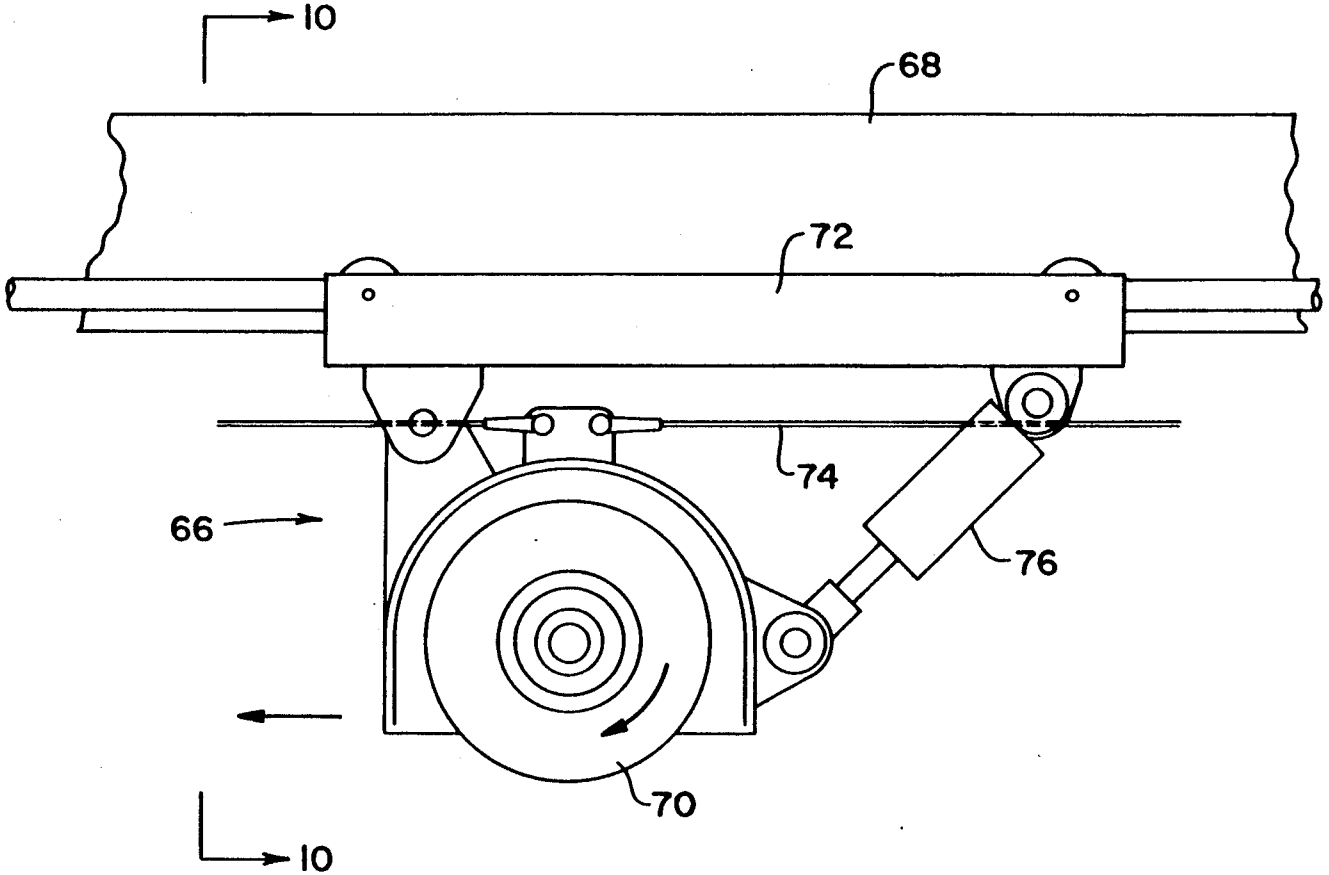
FIG. 9 is a larger scale fragmentary elevation view of the surface preparation station shown in FIG. 8.
Figure 10:
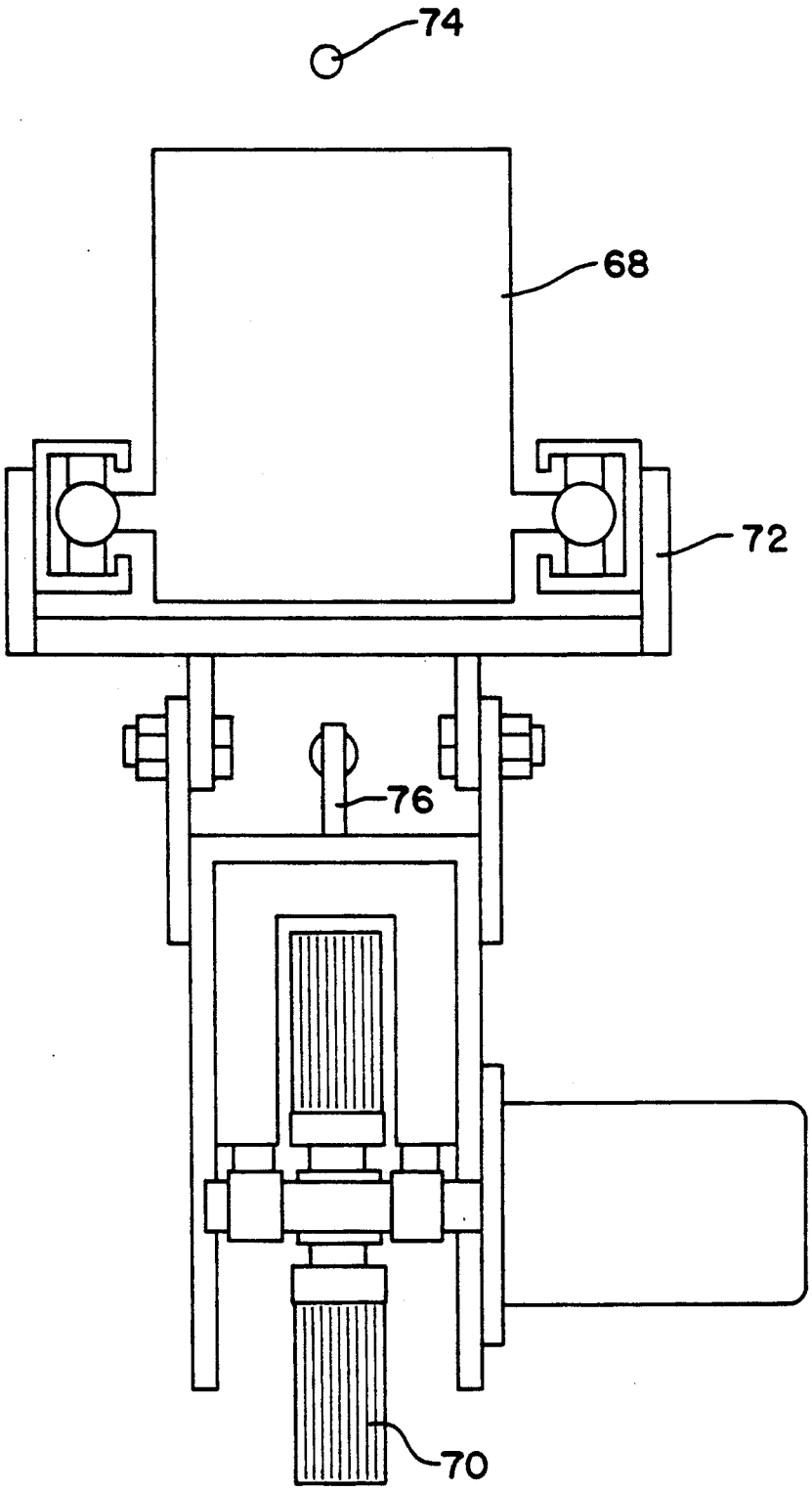
FIG. 10 is a fragmentary cross-sectional view on line 10—10 of FIG. 9.

Raw steel plate destined for curved panels is conveyed on the line 20 to the plate forming machine 26 (FIGS. 1 and 5–7), preferred details of which are shown in FIGS. 5–7, to produce curved steel plates.

The plate forming machine 26 puts a constant radius curve in a succession of steel plates each approximately 8 feet wide and 50 feet long by holding one longitudinal edge of a raw steel plate in a holder 28 and bending the plate along its transverse axis over an upwardly convex stationary die 30 using a series of hydraulically operated screw jacks 32 attached to a series of downwardly concave forming presses 34. The screw jacks 32 of the preferably forming presses 34, hinged at 36 to the stationary base at an edge of the stationary die 30 are operated simultaneously by a common shaft 38 driven by a hydraulic power plant 40 through a reduction gear 42. The fixed side of the plate is held by a series of cams 28 built into the forming presses. The stationary die 30 is fabricated of steel in an "egg crate" type weldment, so that upper edges of its elements cooperate to define the die. Retractable plate conveying devices 44, 46 are built into the plate bending machine. The devices 44, 46, respectively, have v-grooved and convex rimmed rollers 48, 50 at their plate edge and plate underscale engaging upper ends.

The resulting curved but still not sized steel plates are then conveyed on the line 20 to a flame planer 52 (FIGS. 1 and 4), similar to automatic burning machine 2 flat stiffened panels, where they are cut into precise final configuration to provide curved steel plates 54.

Each collocator car 56, comprises a rail car with a roller conveyor on its deck, receives a respective fabricated flat steel plate approximately 8 feet wide and 50 feet long from the automatic burning machine 22 and locates the steel plate in a precise position on the car.

Figure 4:
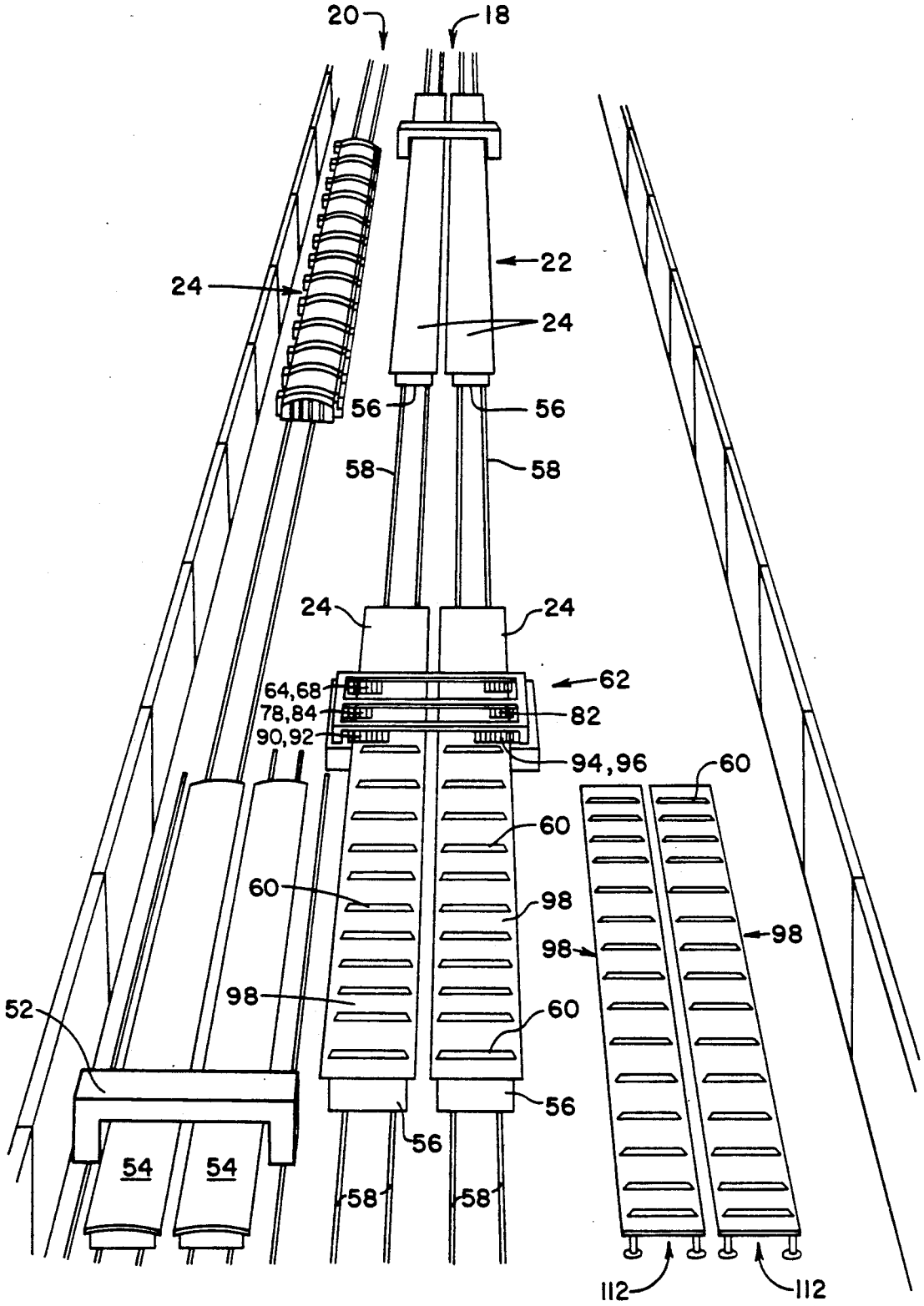
FIG. 4 is a fragmentary pictorial perspective view of apparatus on the line for fabricating the cut plate into curved (at the left) and stiffened flat (at the center and right) panels that will later be assembled with one another to create the module subassemblies.

The flat steel plates 24 are transported by respective collocator cars 56 on rails 58 which continue the flat panel lines 18 (FIG. 4) where kickplate stiffeners 60 are installed at precise intervals (typically of approximately 32 inches) in a three-stage stiffener installation mechanism 62 (FIGS. 1 and 4). In order to facilitate this, each collocator car 56, on which a respective flat steel plate 24 is resting, advances by indexing forwards at the same precise intervals using an appropriate gear mechanism.

The first stage, 64 (FIGS. 1, 4 and 8–10), of this stiffener installation mechanism utilizes a grinding machine 66 to remove an approximate 2-inch wide path of mill scale in the way of where each stiffener 60 will be installed. The grinding machine 66 comprises a fixed gantry 68 containing one or more power-rotated grinding wheels 70 mounted on a carriage 72 running transverse to the line of travel of the collocator cars 56, which remove a path of mill scale approximately 2 inches wide in successive precise increments of approximately thirty-two inches as each collocator car 56 is indexed from position to position beneath it. The grinding wheel carriage 72 is electrically driven through a belt or chain mechanism 74 across the gantry. A pneumatic cylinder 76 holds the grinding wheel 70 to the plate with proper force.

The second stage, 78, of the stiffener installation mechanism, receives stiffeners from a kickplate stiffener collator 80, precisely fits and holds each stiffener 60 in its turn to a respective location, which has previously been cleaned of mill scale at 64, and tack welds each stiffener, using a tack welder 82, to the flat plate 24. The second stage 78 includes a fixed gantry 84, located a precise distance of approximately thirty-two inches after the grinder gantry 68, running transverse to the lines of travel of the collocator cars and having for each line a guide 86 into which a succession of identical kickplate steel flat-bar stiffeners 60 is inserted one by one as the collocator cars are indexed from position to position beneath the fixed gantry 84. The fixed gantry 84 is equipped with a mechanical, hydraulic or pneumatic mechanism to lower the guides 86 and compress each successive stiffener 60 onto the respective flat plate 24, to enable the stiffener 60 to be tack-welded to the plate using gantry-mounted tack welders 82, and then to raise the guides to permit the collocator cars 56 to index to the next position.

Each kickplate stiffener collator/inserter 80 is a device onto which a bundle of approximately eighteen identical kickplate stiffeners each approximately seven feet long, six inches deep and one-half inch thick is loaded as each fifty-foot long flat plate is processed. Individual kickplates 60 are oriented transverse to the line of flow of the respective collocator car and stacked side by side in the direction of the line of flow of the respective collocator car. The lead kickplate 60 is positioned alongside the opening to the respective guide 86 of the kickplate positioning gantry 84 and inserted into the guide 86 by use of a mechanical, electrical, pneumatic or hydraulic plunger 88 as the respective collocator car 56 and flat plate 24 are indexed into position. Each remaining stack of kickplates 60 is indexed in the same direction as the line of travel of the respective collocator car. Each time each collocator car 56 is indexed thirty-two inches forward, the respective remaining stack of kickplates is indexed one-half inch using mchanical, electrical, hydraulic or pneumatic plungers 88 calibrated mechanically or electronically to the movement of the respective collocator car. Thus, as each flat plate 24 is indexed into the kickplate installation position, a kickplate 60 is always available to be inserted.

Each collocator 80 is structured and functions similar to a transverse feeder on the head end of a magazine of a photographic slide projector.

The third stage 90 of the stiffener installation mechanism final-welds each stiffener 60 in its turn. Alternately, the second and third stages may be combined, with tack welding being eliminated. In the preferred construction, the third staqe comprises a fixed gantry 92 containing for each line a carriage-mounted double fillet, flux-core welding machine 94 or substitute located a precise distance of approximately thirty-two inches after the kickplate installation gantry 78 and oriented transverse to the line of flow of the collocator car. The double fillet welding heads of the welding machine 96 are each equipped with a known seam tracker and appropriate positioning slides to compensate for slightly out-of-flatness of the respective plate 24 or minor misalignment of the kickplate stiffeners 60. The welding machines 96 perform finish welding of individual kickplate stiffeners 60 as the flat plates 24 with fitted kickplates 60 are indexed beneath it on the collocator cars 56, thereby providing stiffened flat panels 98.

Figure 11:
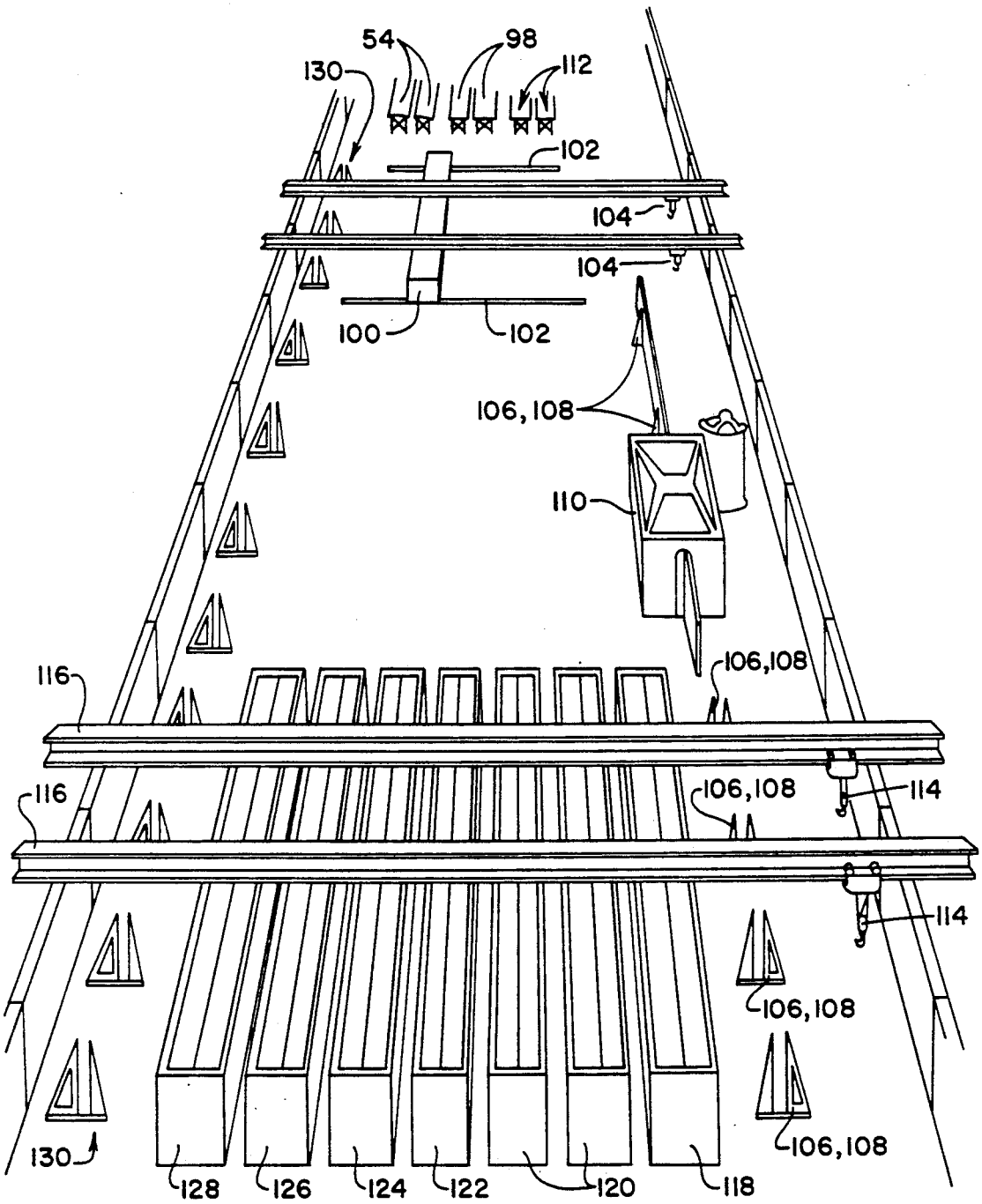
FIG. 11 is a fragmentary pictorial perspective view showing a repair station on the line, for stiffened panels, and a station for surface preparation and coating of both curved and stiffened flat panels.

Fabricated curved panels 54 and stiffened flat panels 98 are then conveyed to a transporter car 100, which travels laterally on tracks 102, and then are lifted by hoists 104 from their horizontal positions to a vertical orientation and places it on a chain drive conveyor 106, so that each rests on one of its long edges. The chain drive conveyor 106 transports panels, through guides 108, into and out of a steel-shot abrasive cabinet 110 (FIGS. 1 and 11) for removal of mill scale, weld slag, weld splatter and other foreign matter.

In the shot-blast cabinet 110, recyclable steel abrasive shot or grit (not shown) is propelled automatically against all surfaces of curved and stiffened flat steel panels 54, 98 being transported through the cabinet by the chain drive conveyor 106 through guides 108 leading into and out of the cabinet. This removes all mill scale, weld slag, weld splatter and other foreign matter from the panels 54, 98.

Fabricated flat panels requiring rework are conveyed by the transporter car 100 to repair stations 112 (FIGS. 1 and 4) and, upon completion of repairs, are transferred to the abrasive cabinet 110, for surface preparation as described above.

After being shot blasted, curved panels and stiffened flat panels are lifted off the exit conveyor guides 108 (FIGS. 1 and 11) of the abrasive cabinet 110 using plate clamps 114 hung from the twin monorails 116 running transversely, and are immersed in a rinse tank 118 containing deionized water.

The plate clamps on the twin monorails 116 transport the shot-blasted panels 54, 98 laterally through the five or more positions of the coating process of which the rinse tank 118 is the first.

The rinse tank 118 contains deionized water and is large enough to accommodate one or more of the panels 54, 98 in a vertical position on one of its respective long edges during its rinse, after abrasive cleaning in the shot blast cabinet 110. A wash and pretreatment process is conducted in the rinse tank 118, plus sufficient tanks 120 for two or more subsequent chemical wash and pretreatment stages.

After chemical wash and pretreatment, the next position of the coating line is a cathodic coating tank 122 containing a paint and water solution and large enough to accommodate one or more of the panels for receiving an initial coating, still in a vertical position. The tanks are provided with fenders (not shown) to protect the coating.

The first coating tank preferably contains epoxy paint in water solution, and in it, each panel is cathodically coated, the coating process commercially available from PPG Coatings called Power Cron 64 conductive epoxy primer being presently preferred.

The next position is a curing position 124 with infrared or other surface heaters (not shown) large enough to accommodate one or more of the panels after its initial coating in a vertical position, with fenders (not shown) to protect the coating.

At this curing position 124, the first coating on the curved and flat panels is cured in the infrared-heating cabinet at approximately 350° F.

The next position is a second cathodic coating tank 126 similar to the one at the second position.

After curing at the first curing position 124, the curved and flat panels are immersed in the second coating tank 126 for a second cathodic coat of preferably the same type of epoxy paint, thereafter are removed to a second infrared heating cabinet 128 at a fifth position, for curing, and then stored vertically on their long sides in a storage rack 130 for inspection, with suitable fendering being provided to protect the coating.

The coated panels are then inspected. Inspection criteria include handling damage to the coating, adhesion of the coating to the steel panel, thickness of the coating (normally 2.9 to 3.5 thousandths of an inch (mils.), and curing (hardening).

Curved and stiffened flat panels with unacceptable coatings are conveyed back to the transporter car 100 for reprocessing through the entire surface preparation and coating processes.

Figure 12:
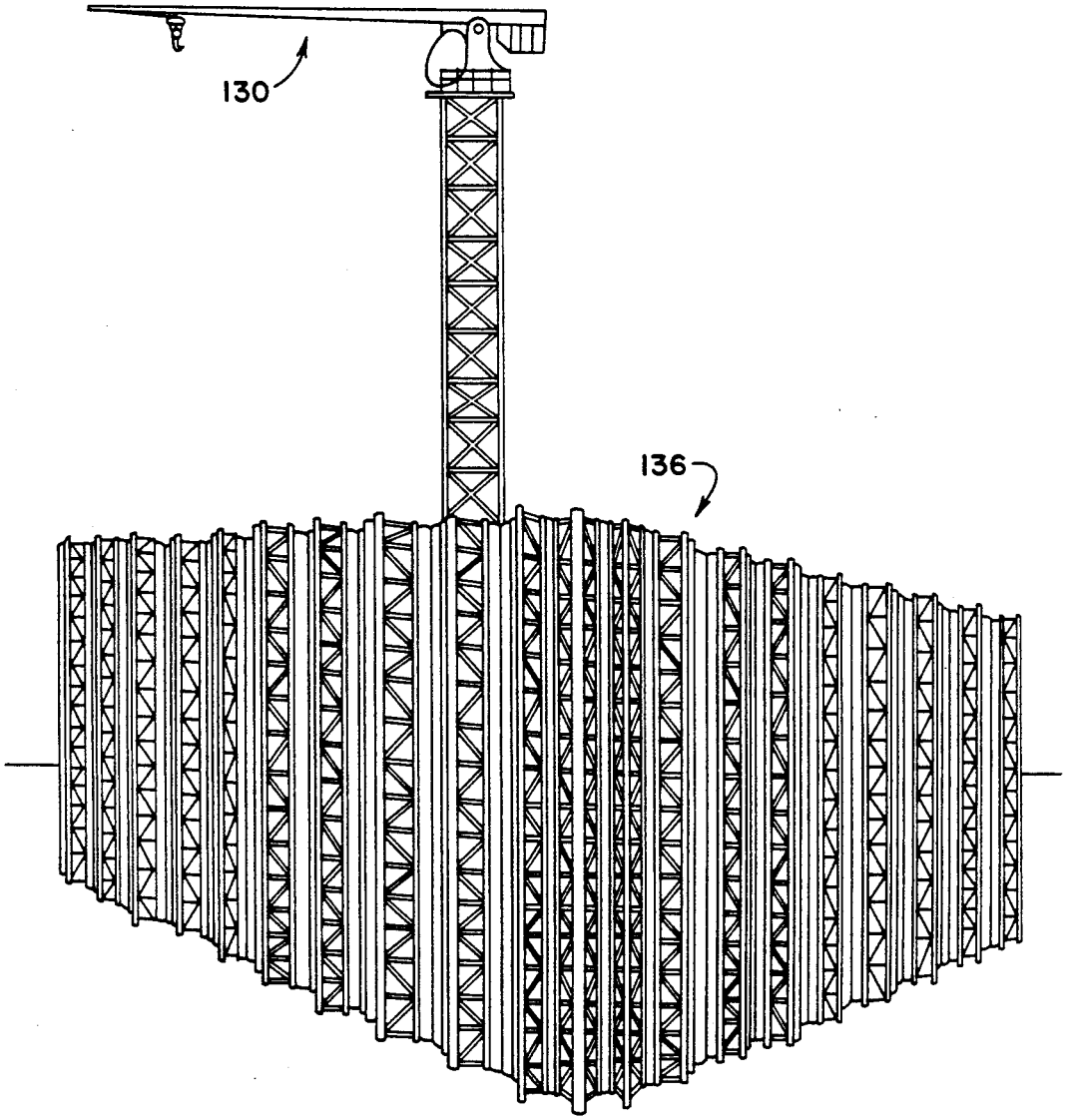
FIG. 12 is a fragmentary pictorial perspective view showing a fixture (shown empty) for receiving the coated curved and stiffened flat panels which are to be joined at respective edges to form a subassembly for a module of a double-hull midbody for a bulk cargo vessel.
Figure 13:
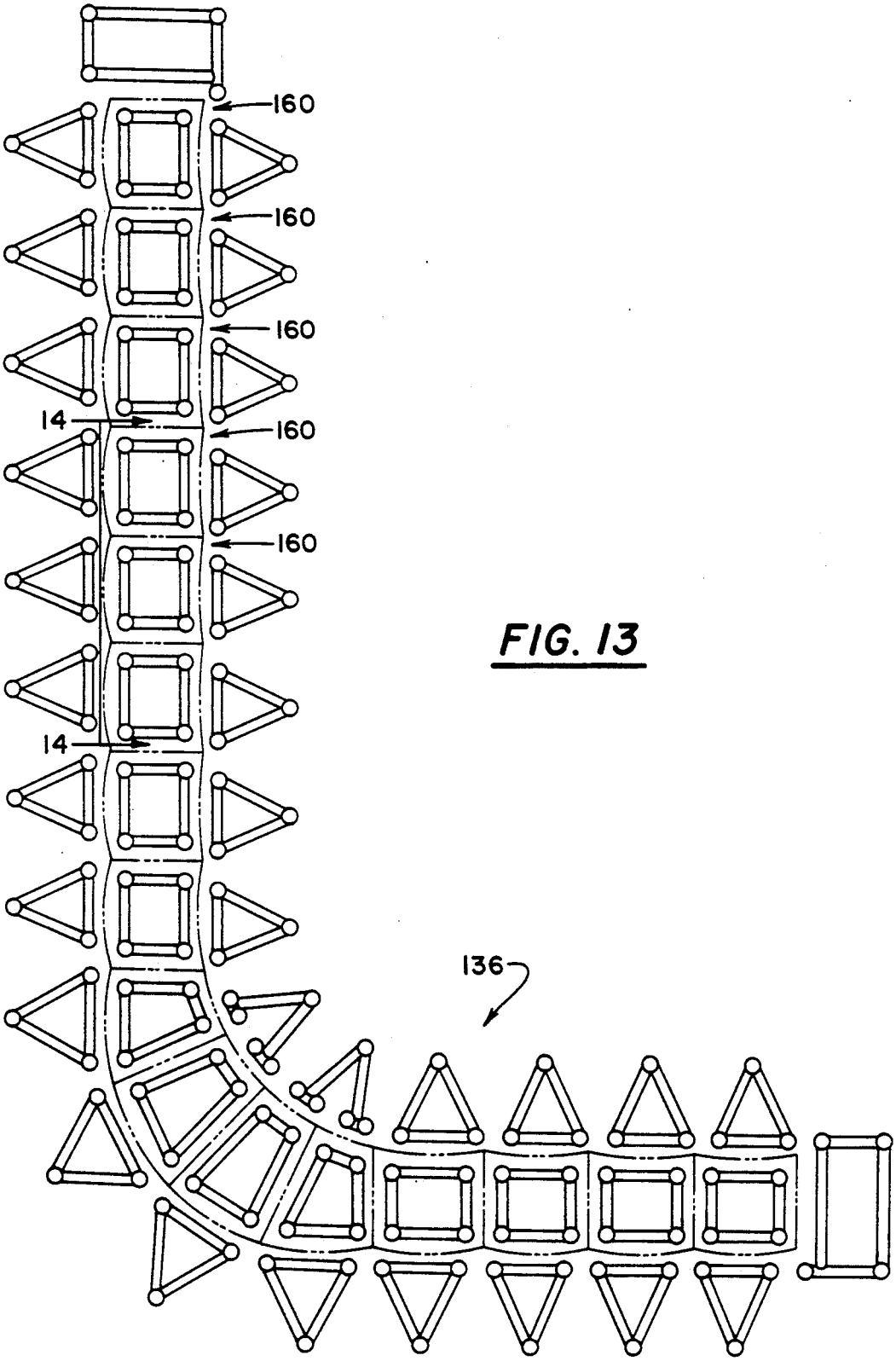
FIG. 13 is a diagrammatic top plan view of the fixture of FIG. 12.
Figure 14:
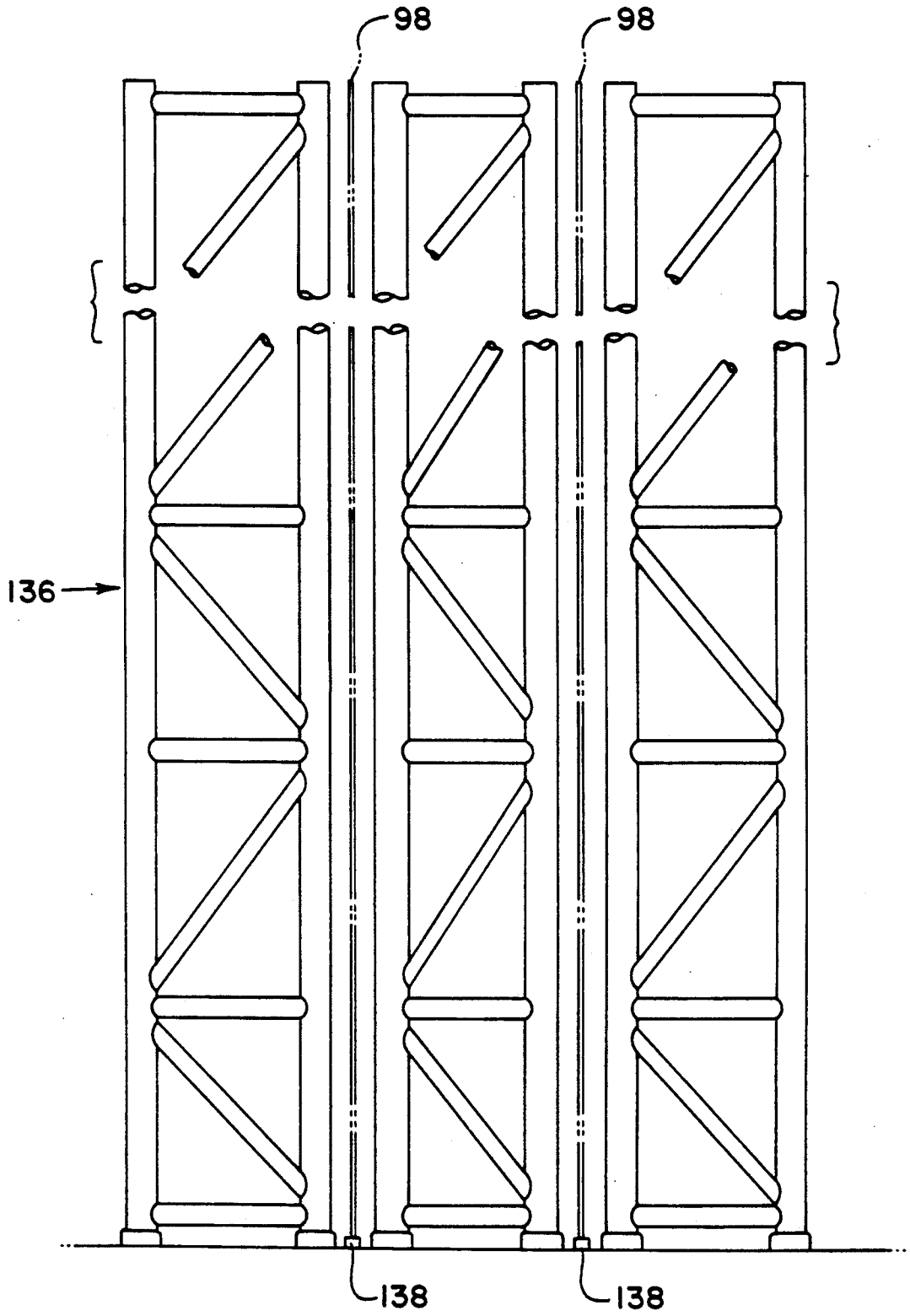
FIG. 14 is a fragmentary vertical longitudinal sectional view on line 14—14 of FIG. 13, showing two flat panels lowered into place in the fixture of FIG. 12.
Figure 15:
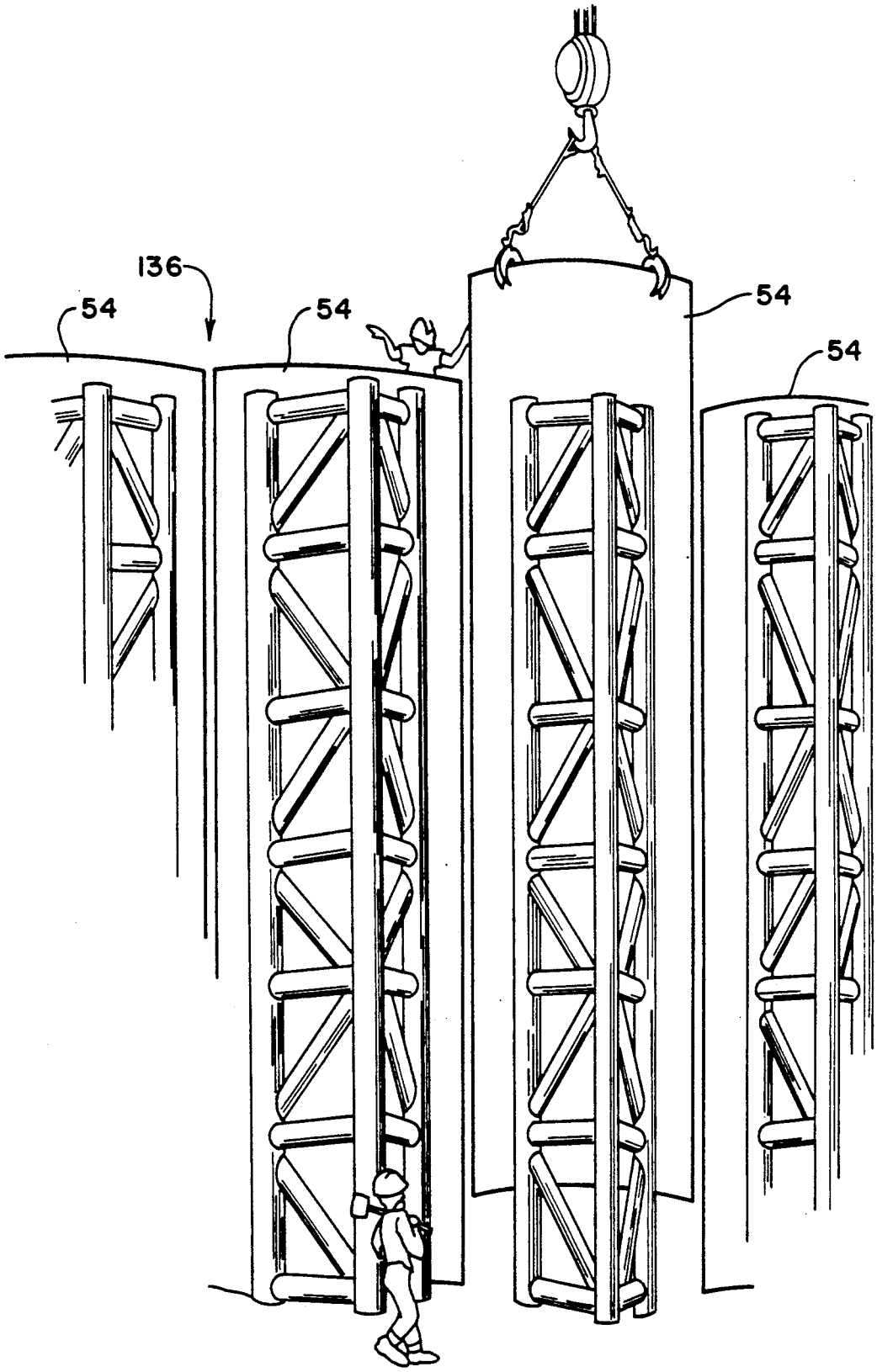
FIG. 15 is a fragmentary pictorial perspective view showing one coated, curved plate being lowered into place in the fixture of FIG. 12.

Curved and stiffened flat panels with acceptable coatings are lifted by a crane 130 (FIGS. 1 and 12), still in a vertical position on their respective end edges and placed either in buffer storage 132 or directly in the subassembly fixture 136 (as shown in FIG. 15).

In the buffer storage 132 or fixture 136, the bottom edges of the curved and flat panels being stored or loaded into the fixture are aligned by landing them in guides 138.

The guides 138 provided at the bottom of the fixture 136 are used for precisely positioning the bottom edges of the curved and stiffened flat panels as they are lowered by crane into the fixture 136, without using temporary attachments.

Figure 17:
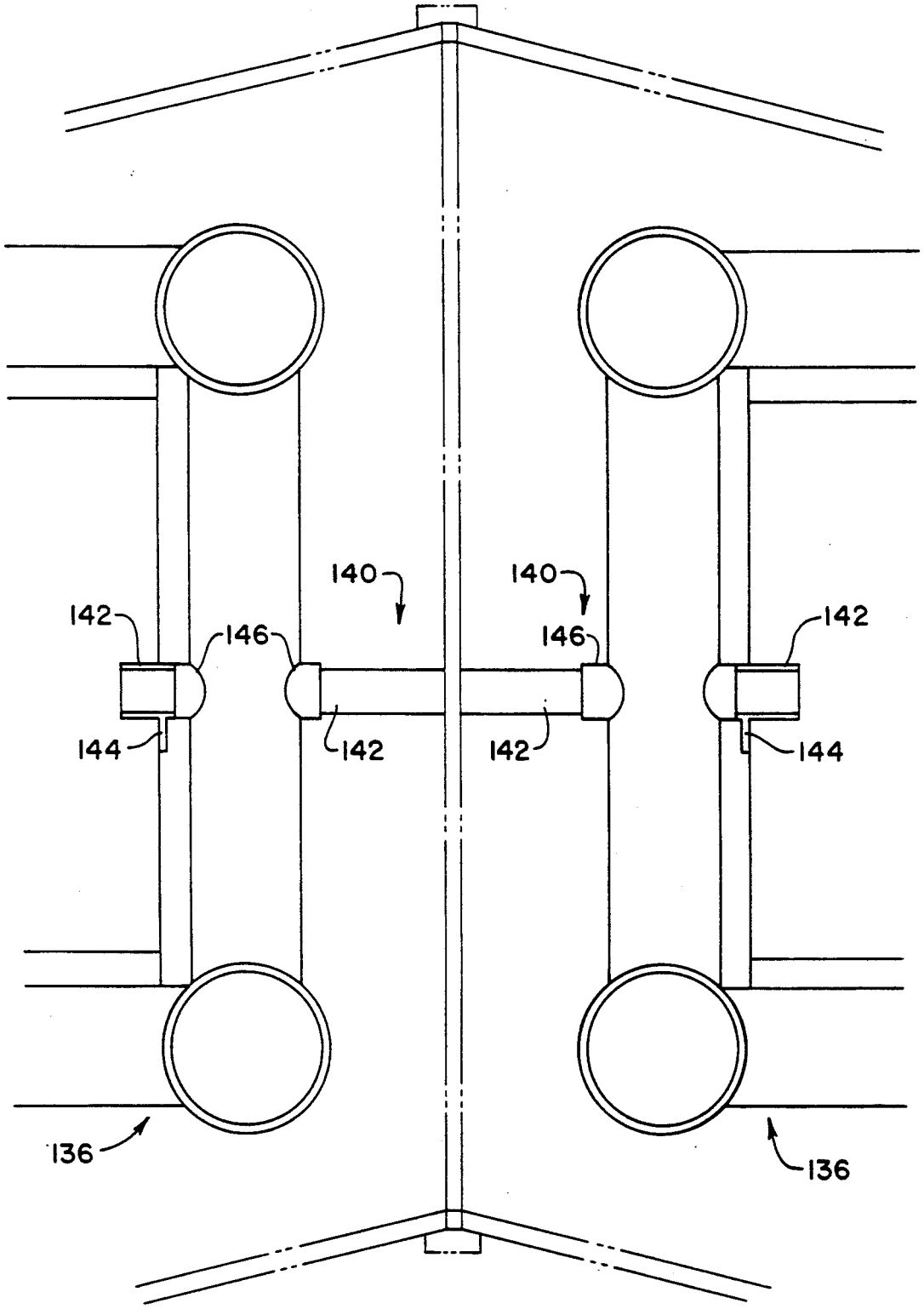
FIG. 17 is a even larger scale fragmentary top plan view of part of the structure shown in FIG. 16.
Figure 18:
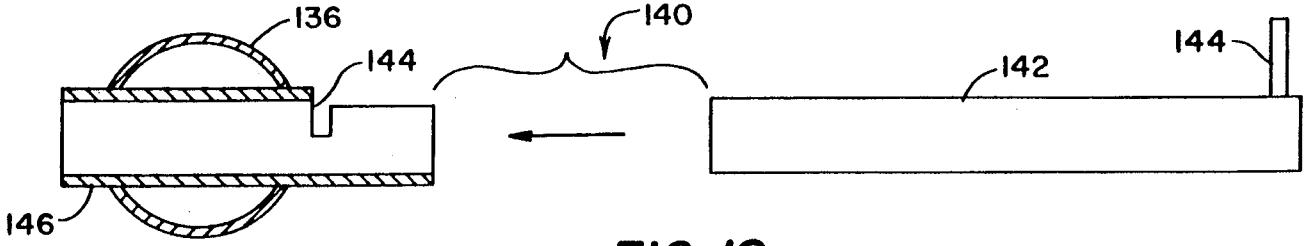
FIG. 18 is a horizontal transverse sectional view of one leg element of one tower of the fixture of FIG. 12, showing the stationary tube of one manual activating mechanism for a flat panel, and, in elevation, the extensible, latchable member of that manual activating mechanism.

In the fixture 136, buckling of the stiffened flat panels is prevented by manually activating mechanisms 140 (FIG. 17 and 18).

Each device 140, a plunger 142, which manually telescopes into and locks at 144 in a fixture leg tube 146, holds a flat stiffened panel in position, to keep the panels from buckling without using temporary attachments.

Figure 19:
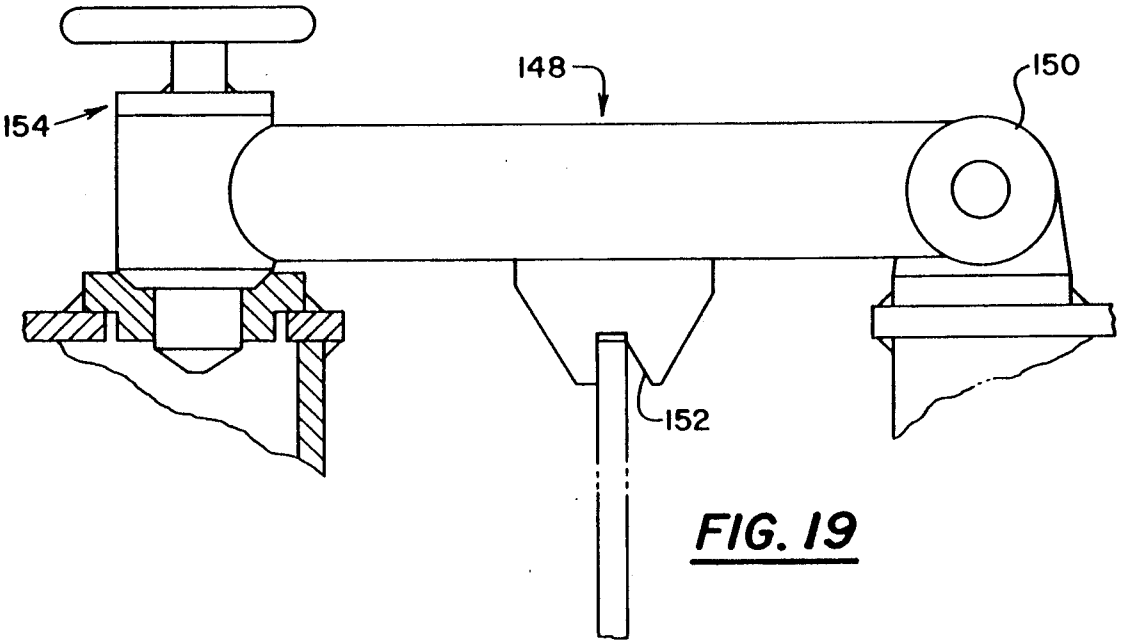
FIG. 19 is a fragmentary elevational view, partly in section, one of the manually activating devices used for aligning top edges of respective ones of the curved and flat panels in the fixture of FIG. 12.

The top edges of the curved and flat panels are aligned by manually activating devices 148 (FIG. 19).

The devices 148, hinged to one fixture leg at 15o, notched at 152 to receive a plate edge and clamped to another fixture leg at 154 precisely position the tops of the curved and flat, stiffened panels, without using temporary attachments.

Figure 20:
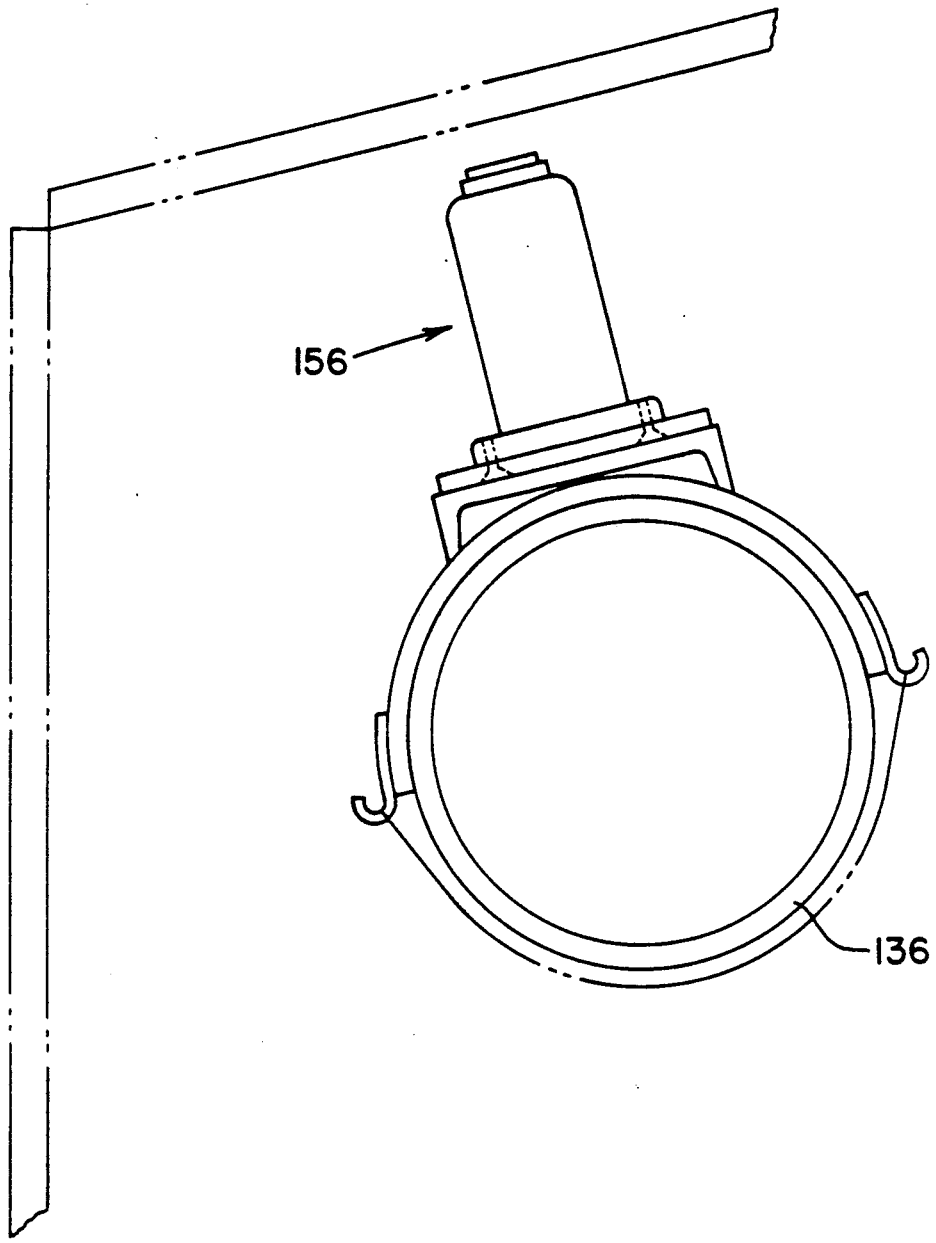
FIG. 20 is a fragmentary top plan view of one of the activating mechanisms used for removing local unfairness of respective ones of the curved and flat panels disposed in the fixture of FIG. 12.
Figure 21:
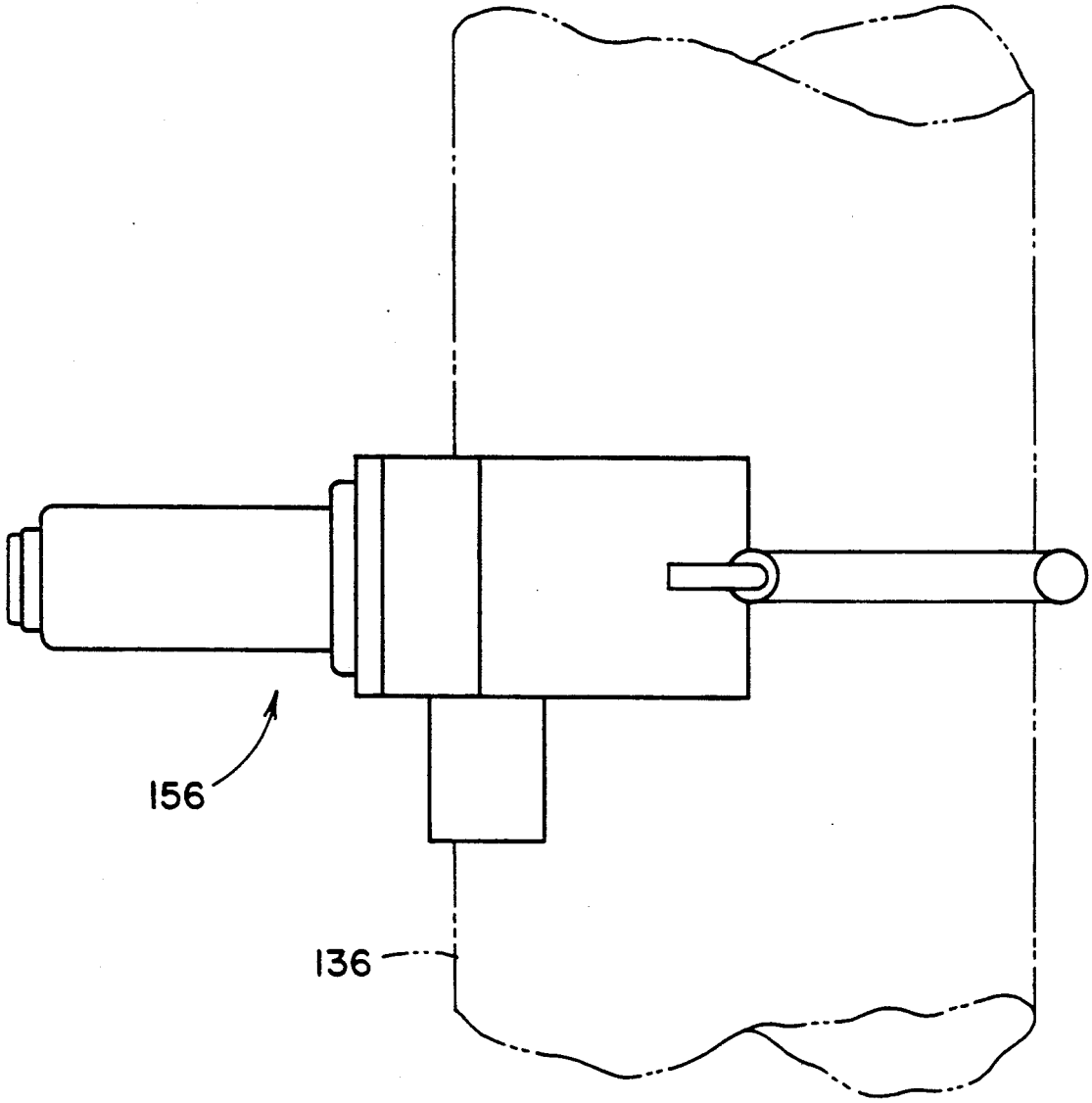
FIG. 21 is a fragmentary side elevation view of the activating mechanism of FIG. 20.

Local random unfairnesses throughout the height of curved and flat panels disposed in the fixture 136 are removed by activating mechanisms 156 (FIGS. 20 and 21).

The devices 156 apply external pressure at intermediate positions on either face of respective curved or flat plate panels to bring unfair edge portions of those plates into precise welding position, without using temporary attachments. Devices 156 are hydraulically operated and are portable, and can be moved around the fixture 136 and secured to legs or leg braces, as needed, and hydraulically activated to forcefully engage and thus fair the panels as required.

Figure 22:
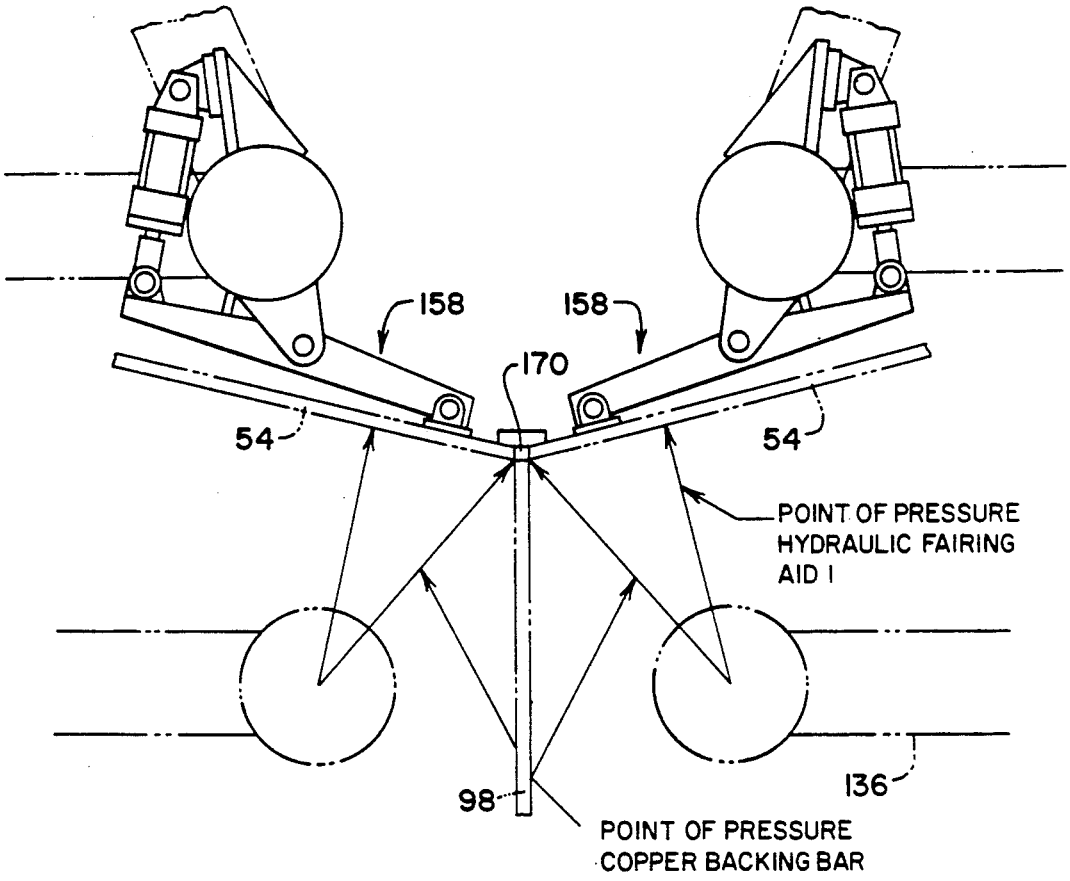
FIG. 22 is a top plan view showing how two curved panels and one flat panel are supported in the fixture of FIG. 12 at an adjacent the site where a three-edge T-joint will be welded, in particular showing where pressure is applied by respective fairing aids of FIGS. 20 and 21, and respective copper backing bars of FIGS. 23–28.

The hydraulically operated devices 158 (FIG. 22) are operated to apply external pressure at intermediate positions along edges of the curved plate panels to positively position the edges against the continuous copper backing bars (to be described). Devices 158 are hydraulically operated and are fixed to legs of the fixture 136.

Figure 16:
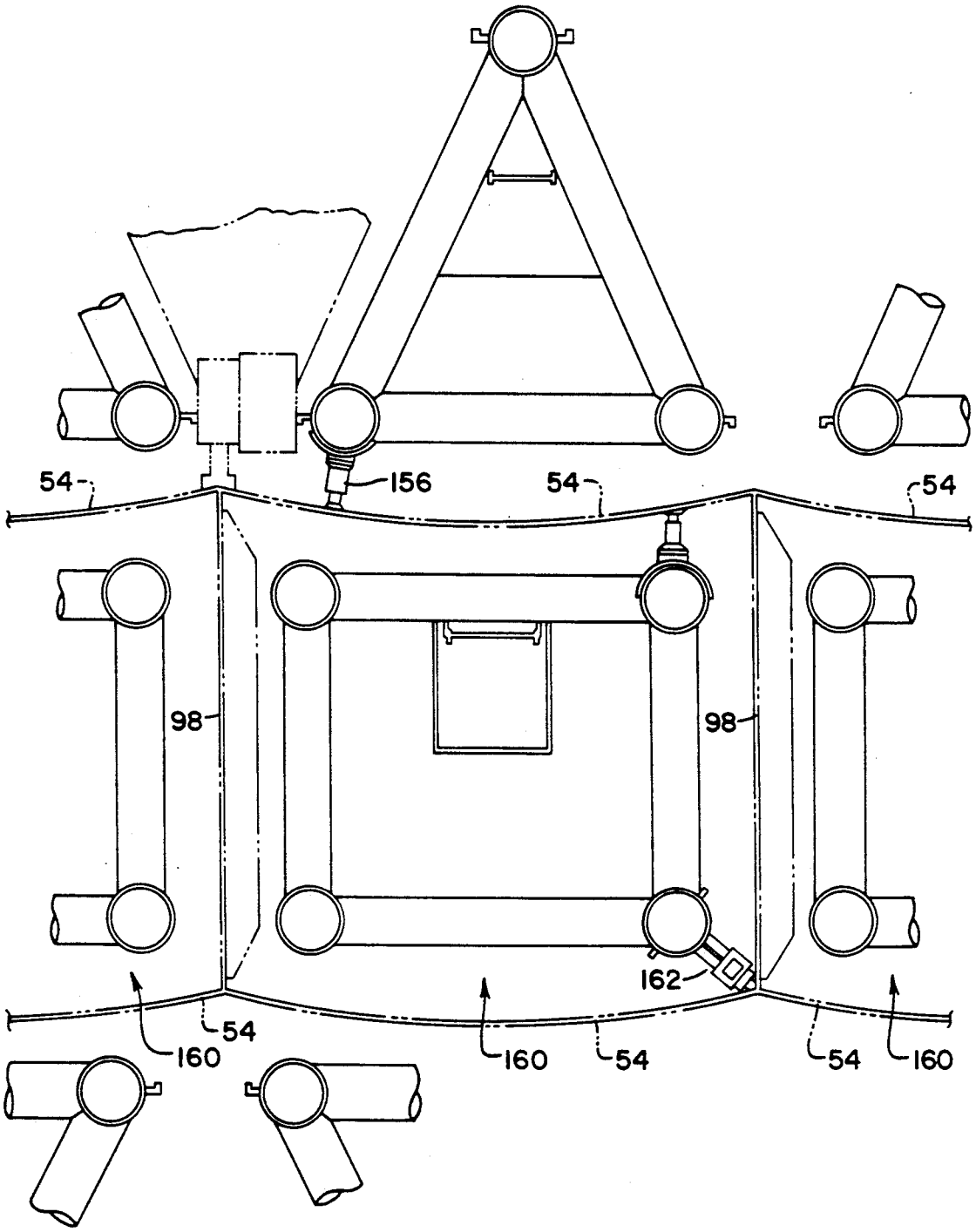
FIG. 16 is an enlarged scale fragmentary top plan view of the fixture of FIG. 12 after a complete set of flat and curved panels has been lowered into place and devices that will be further explained with reference to FIGS. 17–22 have been activated for holding the panels in place for welding of edge joints between respective adjoining edges of respective panels.
Figure 23:
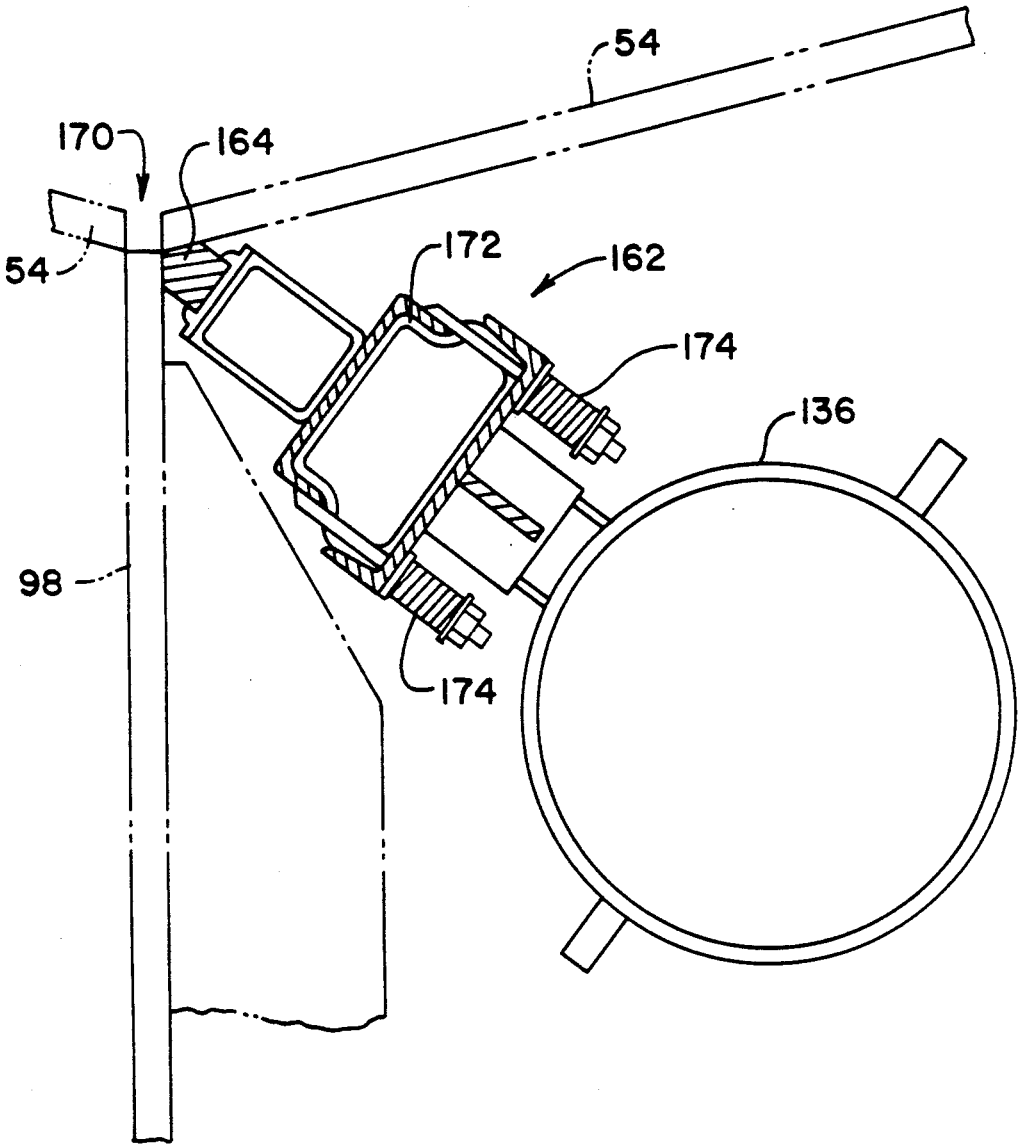
FIG. 23 is an enlarged scale horizontal transverse cross-sectional view of one copper backing bar and an actuator therefor.
Figure 24:
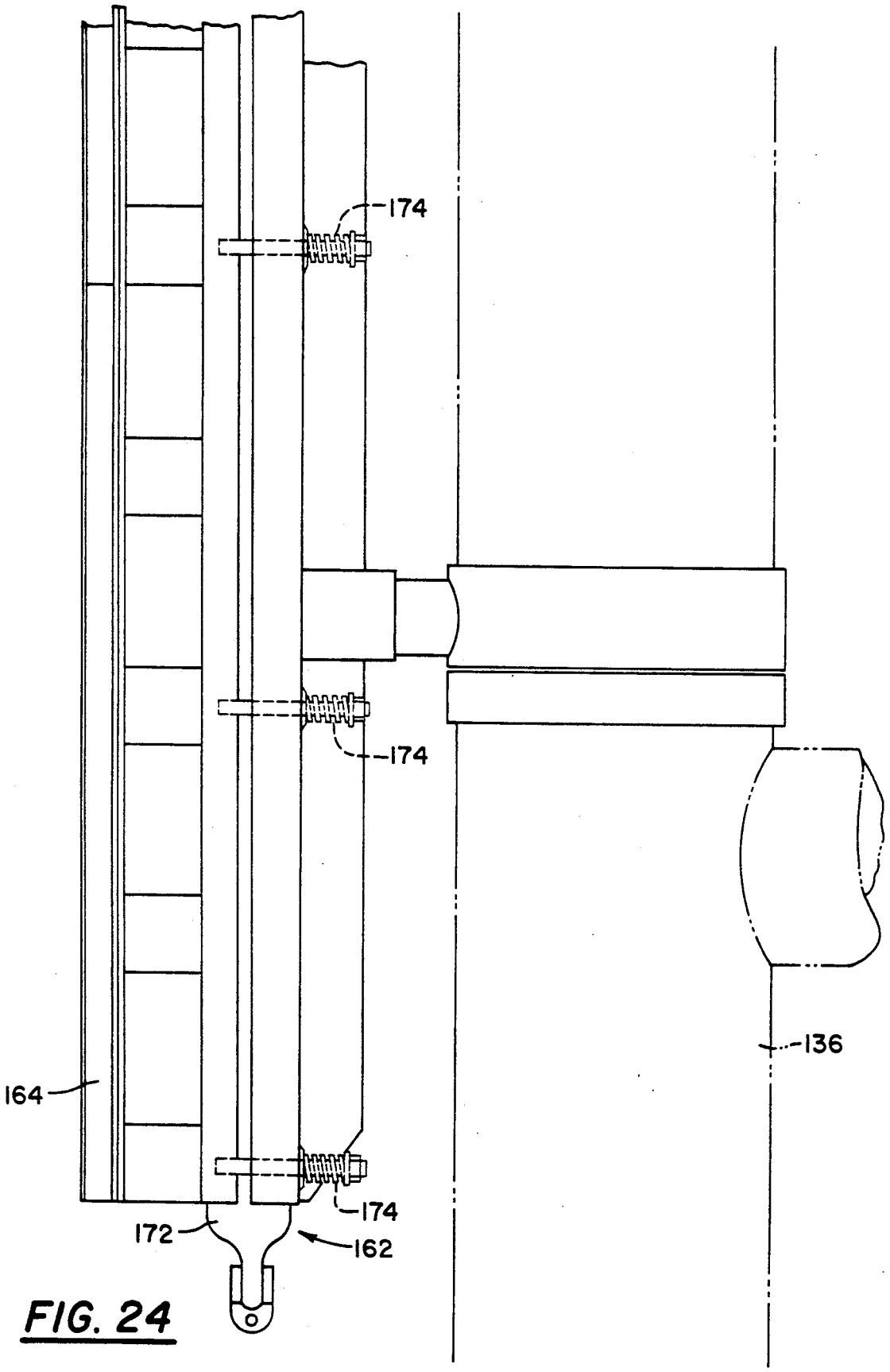
FIG. 24 is a fragmentary side elevation view of the structure shown in FIG. 23.

After all of the curved and flat panels have been brought into proper alignment in a given cell 160 of the fixture I36, mechanisms 162 (FIGS. 16, 23 and 24, only respective ones of which are shown), located in each of the four interior corners of each cell 160, are activated to position the continuous copper backing bars 164, 166, 168, which are variously of the cross-sectional configurations shown in FIGS. (23, 24, 27) 26 and 28.

The devices 158 position the continuous copper backing bars 164, 166, 168 in internal corners of each near intersection 170 between adjacent edges of curved and stiffened flat panels 54, 98. The backing bars 164, 166, 168 are positioned pneumatically in the valley formed by edge margins of two respective panels, by inflating a flexible hose 172, thus forcing the backing bar 164, 166, 168 with positive force into damming relationship with the two panels near the intersection. When the electrogas welding (of FIG. 25) is completed, air pressure is released from each hose 172 and a spring mechanism 174 returns the backing bars 164, 166, 168 to their original retracted positions.

Figure 25:
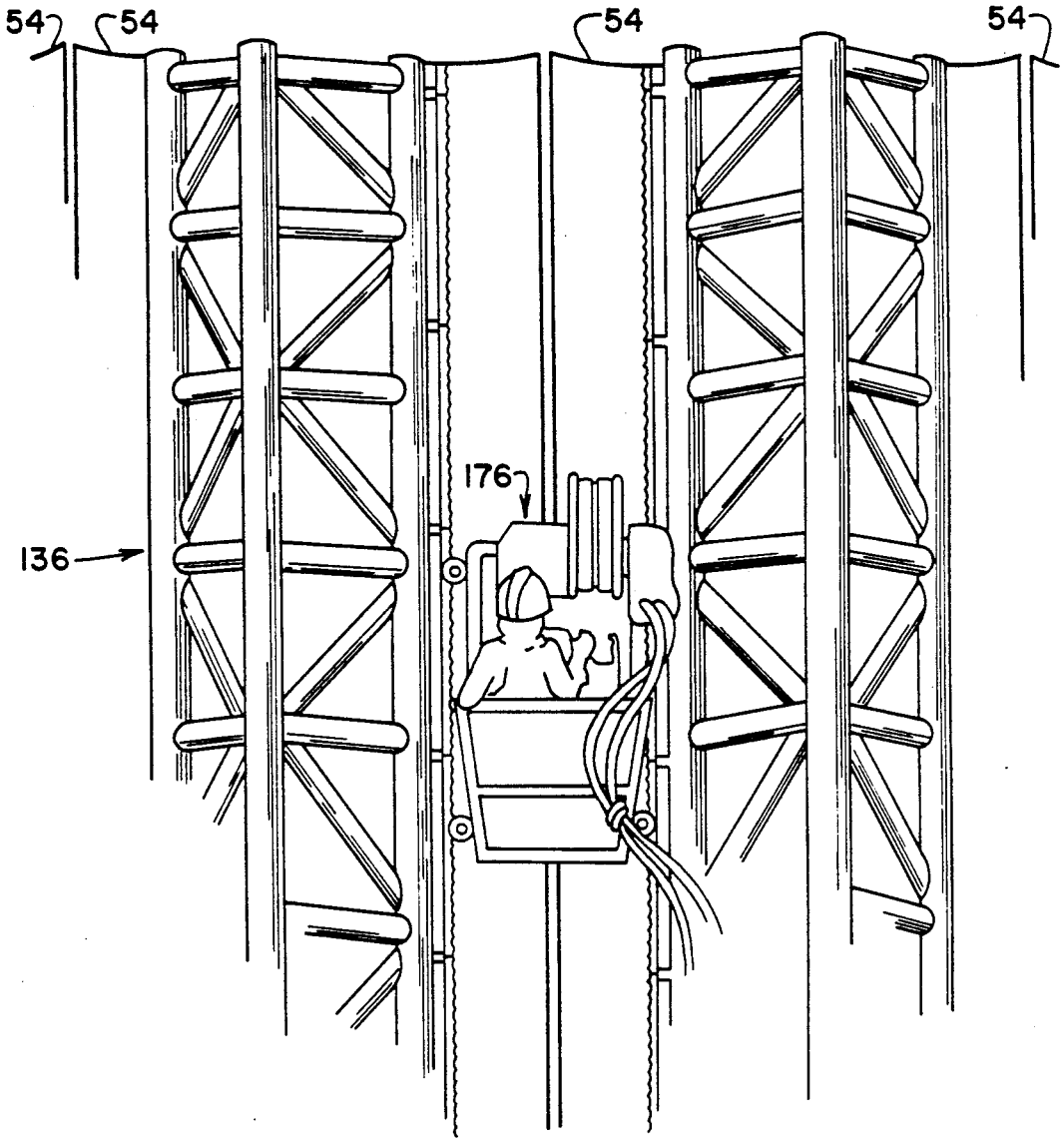
FIG. 25 is a fragmentary pictorial elevational view showing electrogas welding of a T-joint among adjacent edges of two coated curved panels and one coated stiffened flat panel, all as held in the fixture of FIG. 12.
Figure 26:
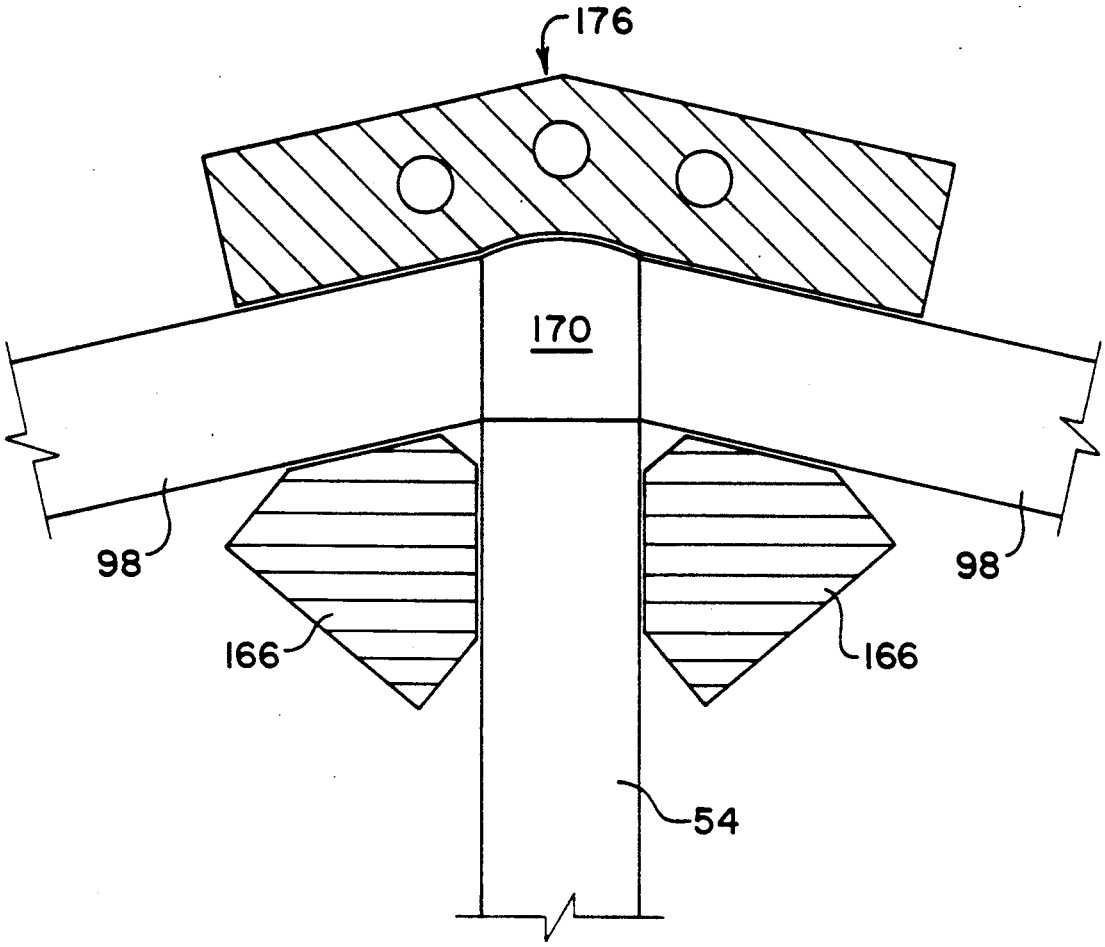
FIGS. 26, 27 and 28 are fragmentary horizontal transverse cross-sectional views of respective portions of subassembly being fabricated in the fixture of FIG. 12, showing the plate edges, copper backing bars and copper sliding shoes at sites where three different types of joint configurations are being welded for respective portions of the double-wall vessel hull module subassembly.
Figure 27:
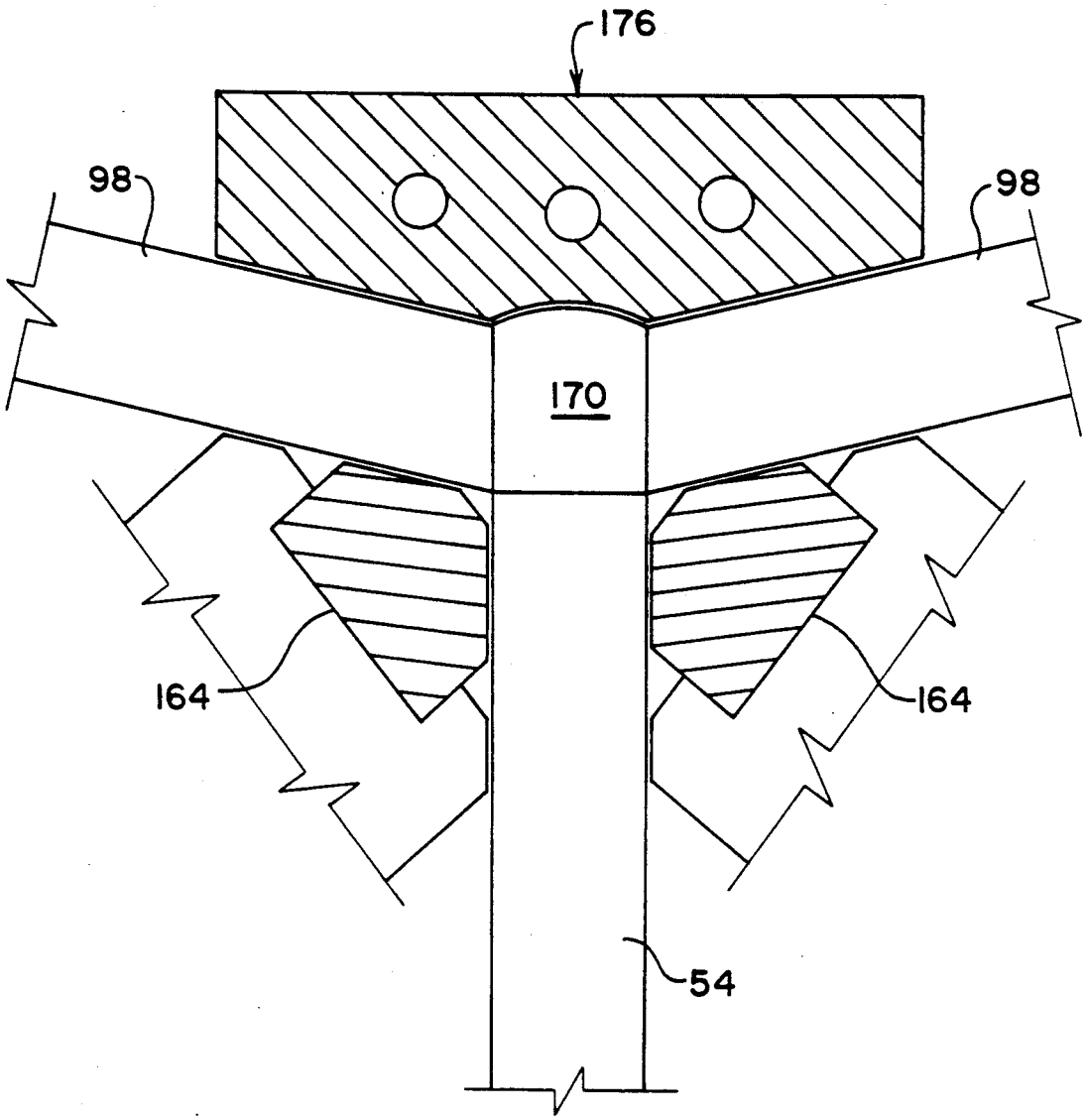
Figure 28:
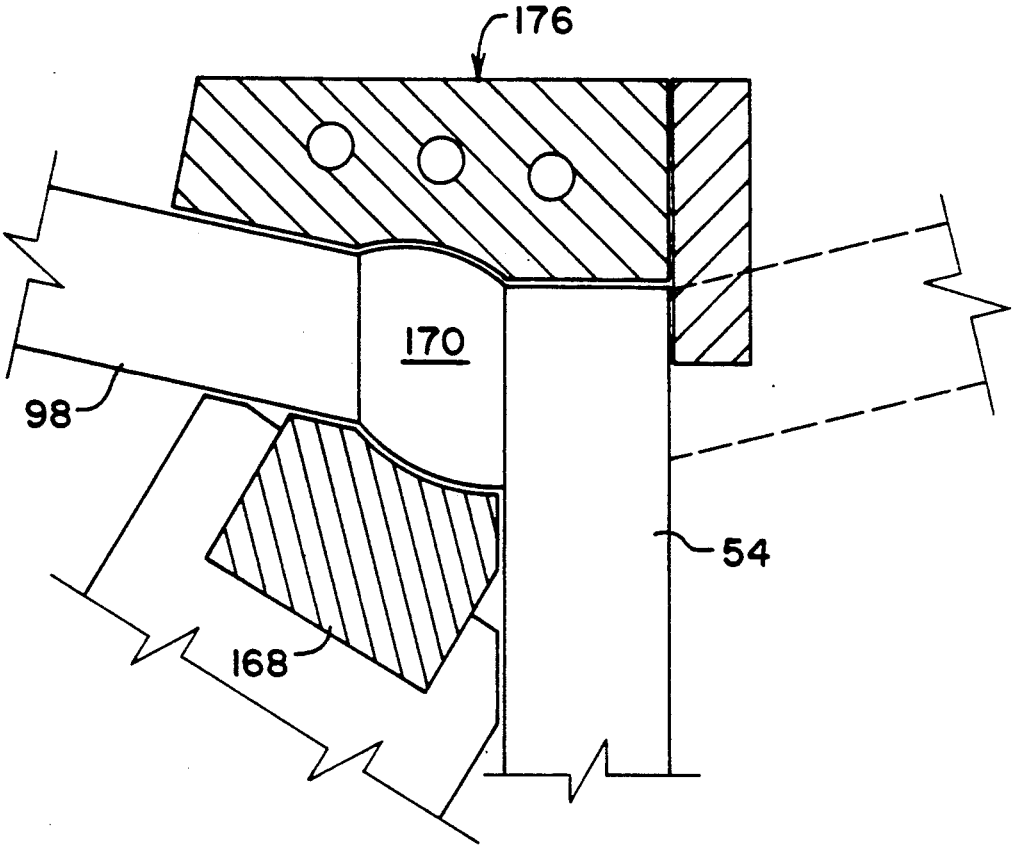
Figure 29:
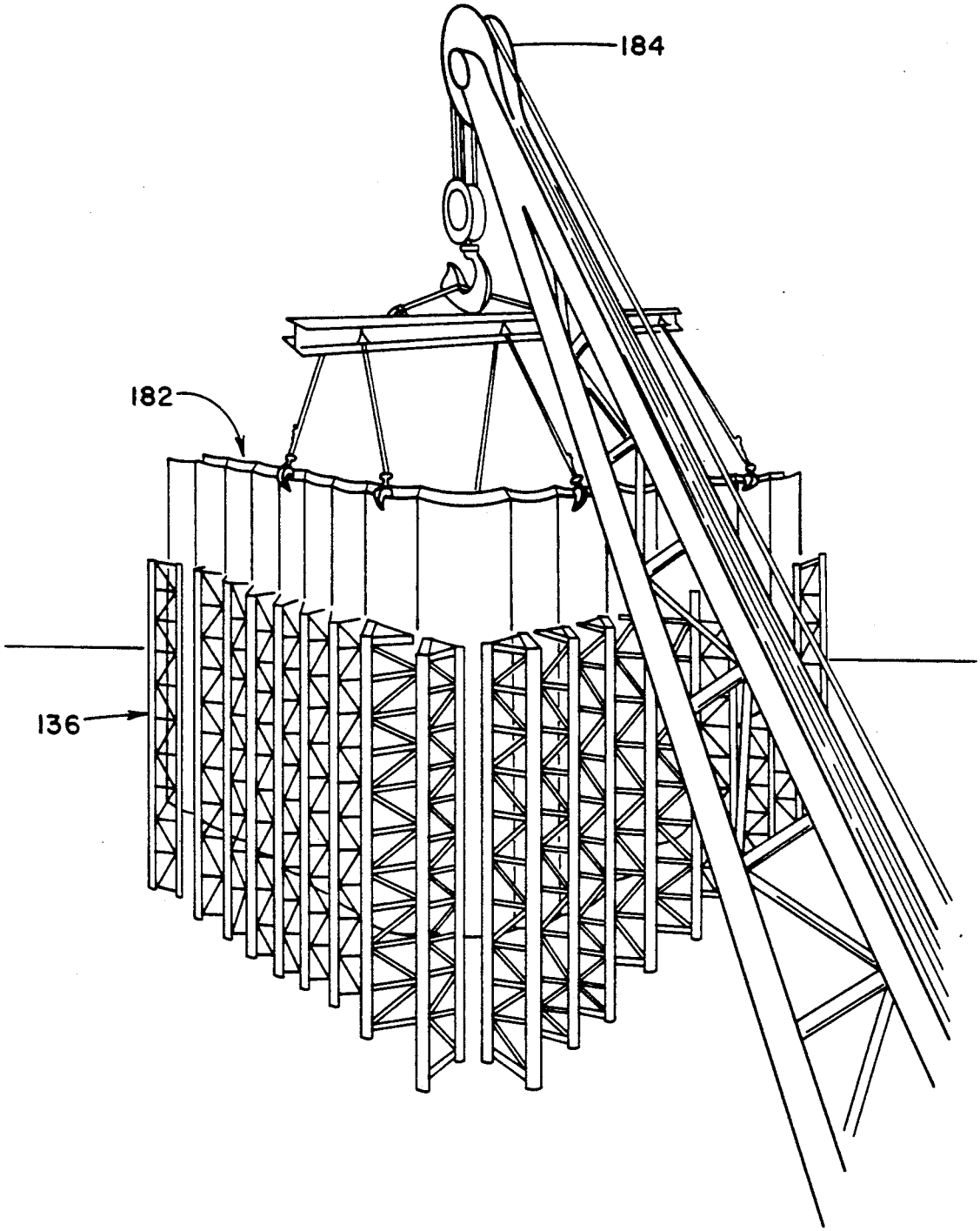
FIG. 29 is a fragmentary pictorial perspective view showing a module subassembly being removed from the fixture of FIG. 12 following completion of welding of the welded joints which interconnect the various curved and flat panels along their respective edges.

After the curved and flat panels 54, 98 are brought into alignment and the interior copper backing bars 164, 166, 168 are in extended, damming position, weld joints, joining three or two panels simultaneously, with transverse cross-sections shown in FIGS. 26, 27 or 28, are welded, using a vertical eleotrogas welding machine (FIG. 25). As welding machine 176 vertically rises, it is followed by a vacuum-blast nozzle, or needle gun 178, which removes exterior welding slag, welding splatter, burned paint, and foreign matter. The cleaned surface is then primed and finish painted by the weld machine operator, e.g., using a paint spray applicator 180 as the operator lowers the welding machine 176.

After electrogas vertical welding is complete and exterior of the welds have been prime painted, the panel and backing bar alignment devices 140, 148, 156, 158 and 162 are released.

Figure 30:
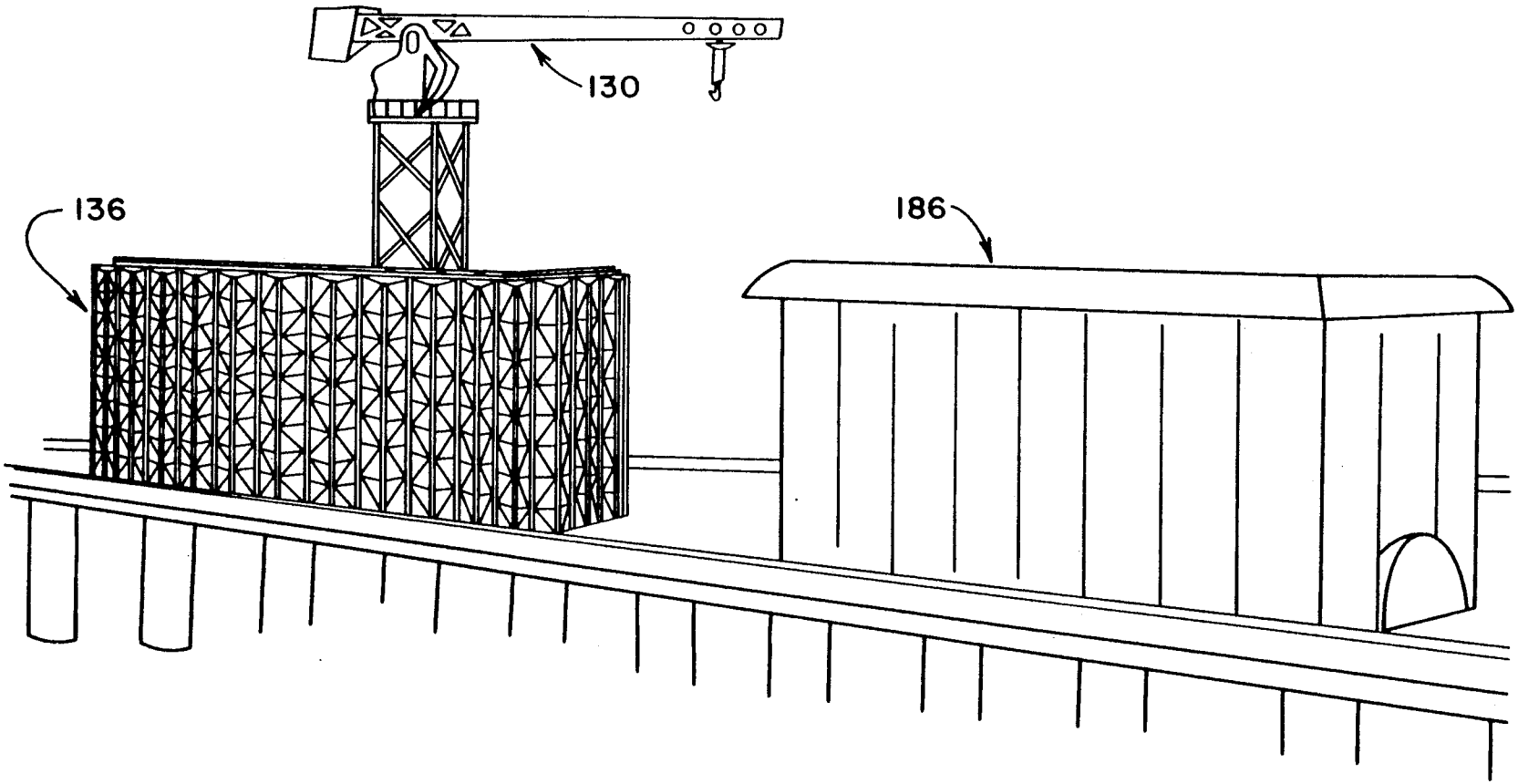
FIG. 30 is a fragmentary pictorial perspective view showing the fixture of FIG. 12, an adjacent facility used for surface preparation and touch-up coating of the subassembly for repairing damage to the coating earlier provided on the panels caused by the electrogas welding depicted in FIG. 25 (including the adjoining crane of FIGS. 12 and 15, that was used for lowering curved and flat panels into the fixture), and a surface preparation and coating touch-up facility for the subassembly, which is brought thereto by the floating crane of FIG. 29.
Figure 31:
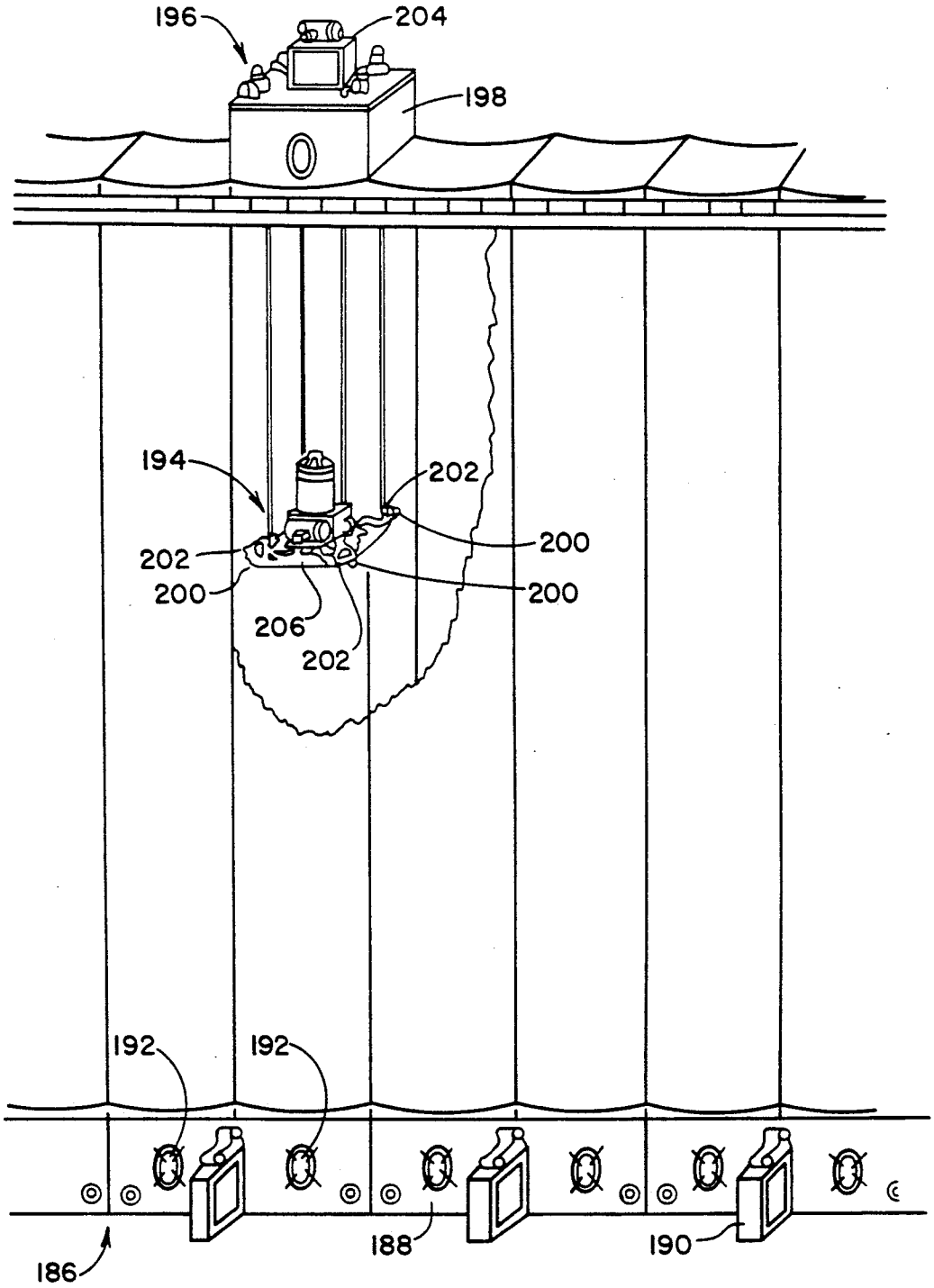
FIG. 31 is a fragmentary pictorial perspective view, partly broken away for showing the interior of a subassembly cell, illustrating surface preparation and touch-up coating of the interior walls of the cell.

The painted subassembly 182 of panels and welds is then lifted from the fixture by a floating derrick 184 (FIGS. 1, 29, 30 and 31) and placed in a subassembly touch-up blast and paint facility 186 (FIGS. 1, 30 and 31).

The main purpose of the touch-up blast and paint facility 186 is to repair interior cell coating damage caused by subassembly welding along interior edges of joints formed at 170 which form the intersection of curved panels 98 and stiffened flat panels 54. The facility 186 includes a supporting structure 188 for the subassembly, with a built-in plenum for intake air to each interior cell 160 of the subassembly including means 190 for dehumidifying intake air and heating it, using steam coils or some other non-explosive means, and, in addition, a means of access 192 to the bottom of each cell 160 to service vacuum-blast and paint equipment 194.

The facility 186 further includes a touch-up blast and paint elevator platform mechanism 196 having a cover 198 which extends over a single interior cell 160 at a time and is adequate for weather protection of that cell.

The cover 198 is provided with an elevator platform 194 having four vacuum-blast nozzles 200 and four paint-spraying nozzles 202, one of each for each interior corner of a respective cell. The platform is suspended from the bottom of the cover at all four corners by a wire rope and pulley arrangement 196 which permits synchronous raising of each corner of the platform at speeds appropriate for both automatic vacuum blasting and automatic spray painting of corners of each individual subassembly cell where welding along the edges of the panels has damaged the coating.

An explosion-proof exhaust fan 204 is mounted in the cover 198, with replaceable filters that are capable of entrapping the paint overspray which will be created by spray painting repaired areas of coating along vertical edges at intersection of curved and stiffened flat panels damaged by welding.

The vacuum-blast machine 194 is mounted on the platform and has four nozzles 200 which are oriented toward the four interior corners of the subassembly cell to accomplish recyclable abrasive blasting of areas along panel edges where the coating has been damaged, in order to remove burned paint, weld slag, weld splatter and other foreign material as the platform is raised in an appropriate speed.

Similarly, four appropriate spray painting nozzles 202 with appropriate supporting air and paint hoses are attached to the platform 206 and oriented toward the interior corners of the respective subassembly cell 160 to enable spray painting of areas vacuum blasted above as the platform is raised at an appropriate speed.

The subassembly 182, after this cleaning and painting, is lifted from the touch-up blast and paint facility 186 using the floating derrick 184, and located onto a barge 208 (FIG. 1) for delivery to another location in the shipyard (or to another shipyard altogether) for subsequent module assembly, module erection and tanker longitudinal midbody construction and tanker completion, e.g., using the method and apparatus which is disclosed in more detail in the above-identified application of Cuneo et al.

Figure 32:
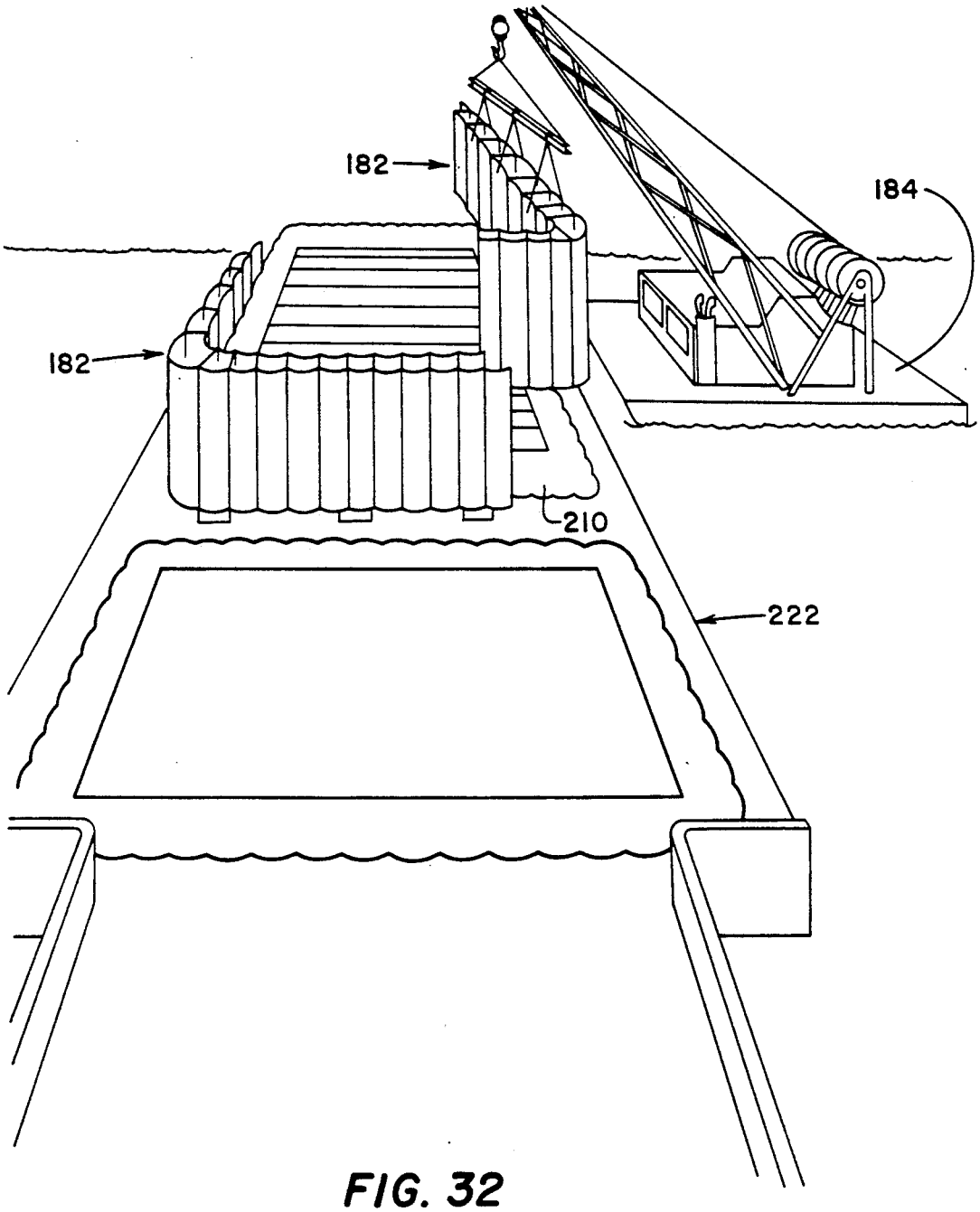
FIG. 32 is a fragmentary pictorial perspective view showing the locations of two adjacent stations for assembly of respective transverse bulkheads, and a set of module subassemblies being assembled onto a transverse bulkhead at one of these stations, for creating a module for a midbody of a double-hulled vessel.
Figure 33:
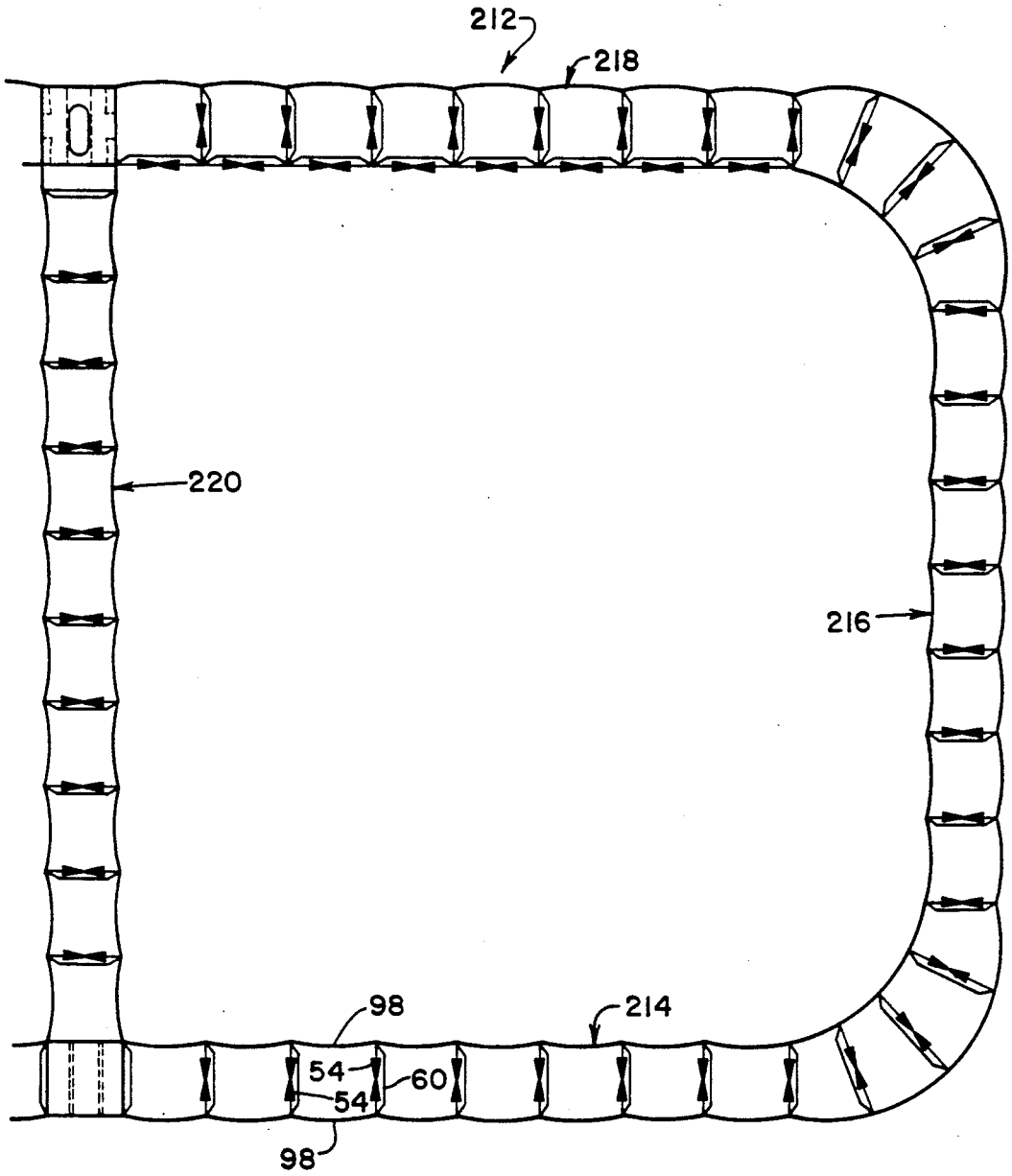
FIG. 33 is a fragmentary diagrammatic end view of a completed module at an open end.
Figure 34:
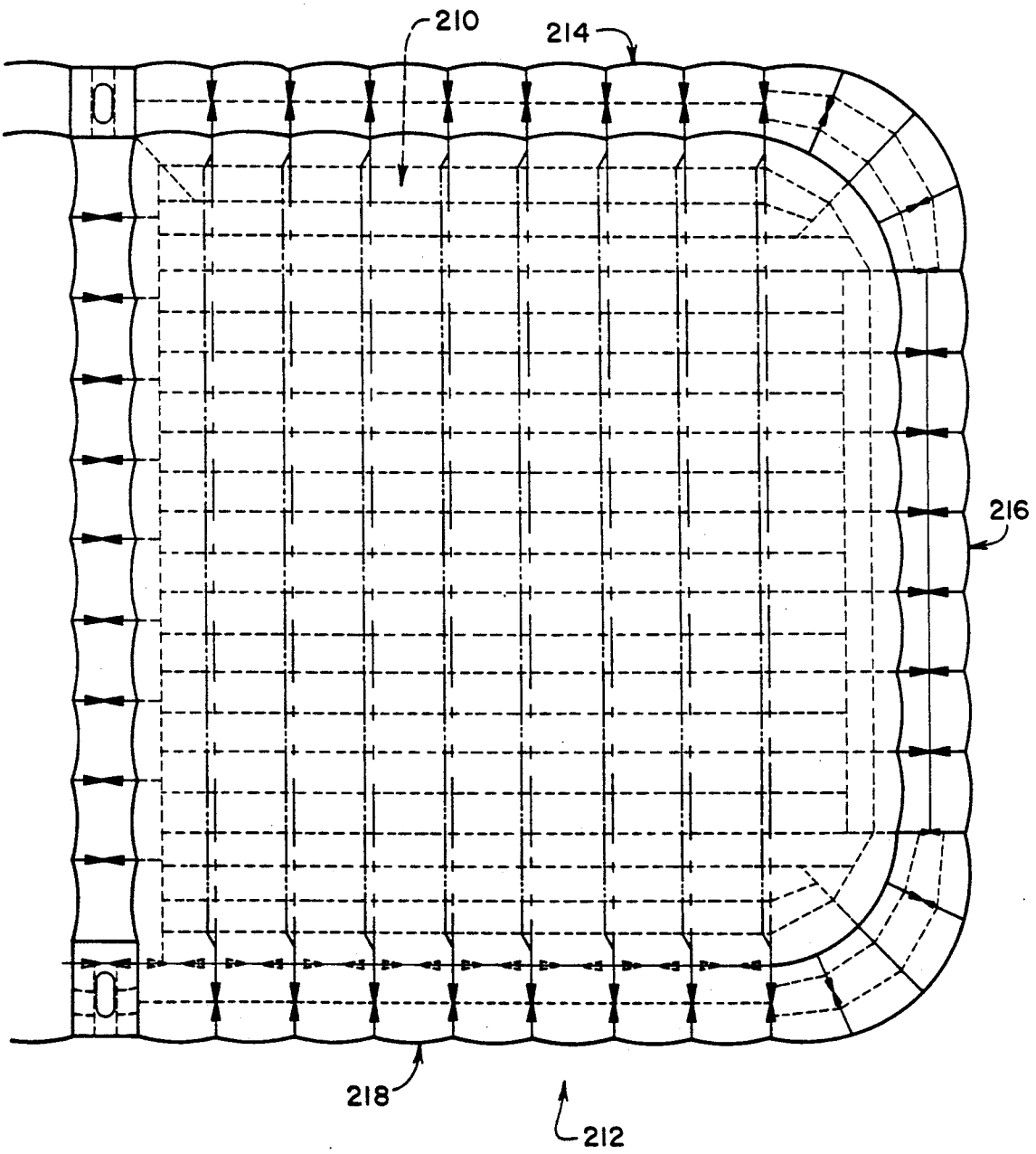
FIG. 34 is a fragmentary diagrammatic end view of a completed module at an end closed by a transverse bulkhead.
Figure 35:
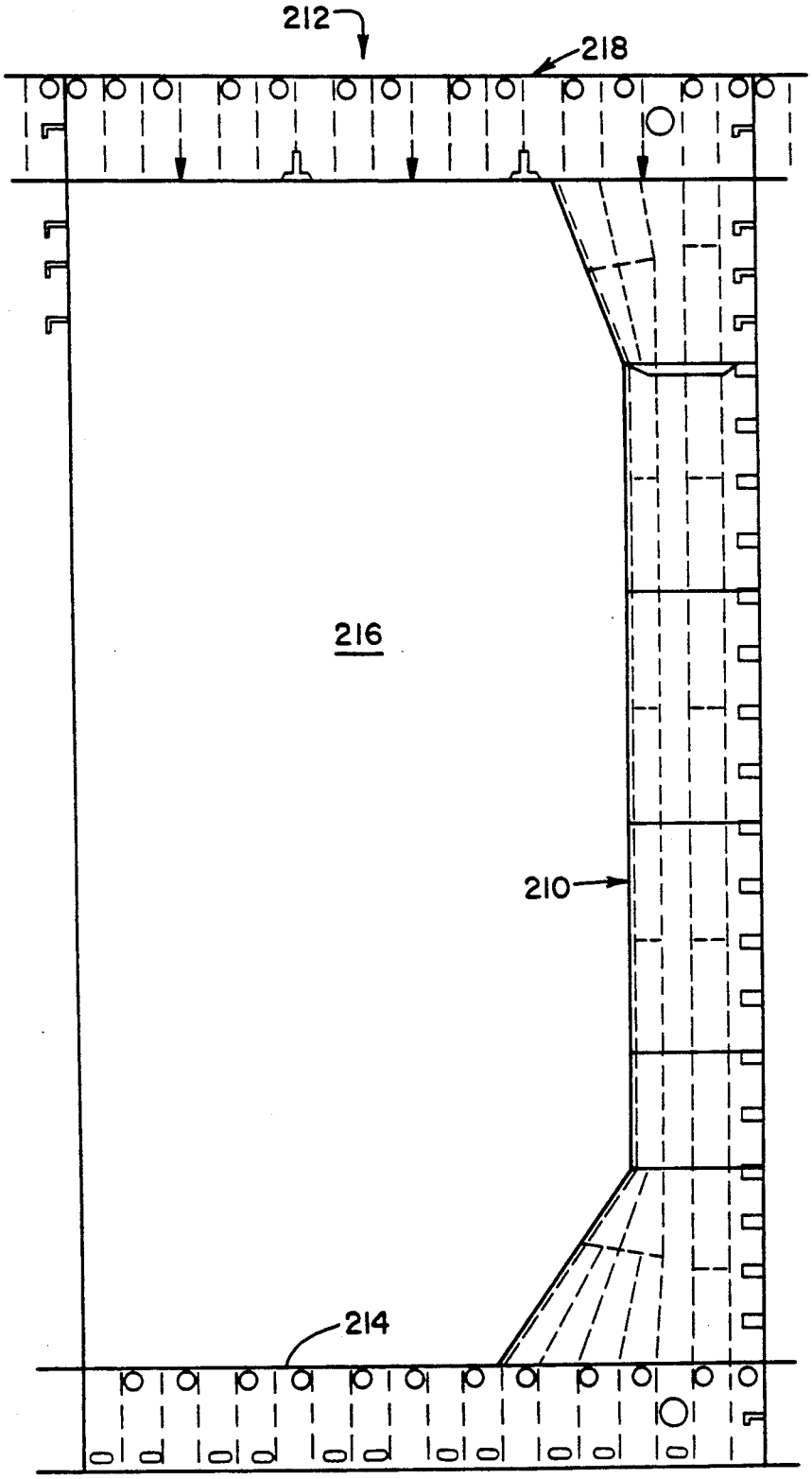
Figure 36:
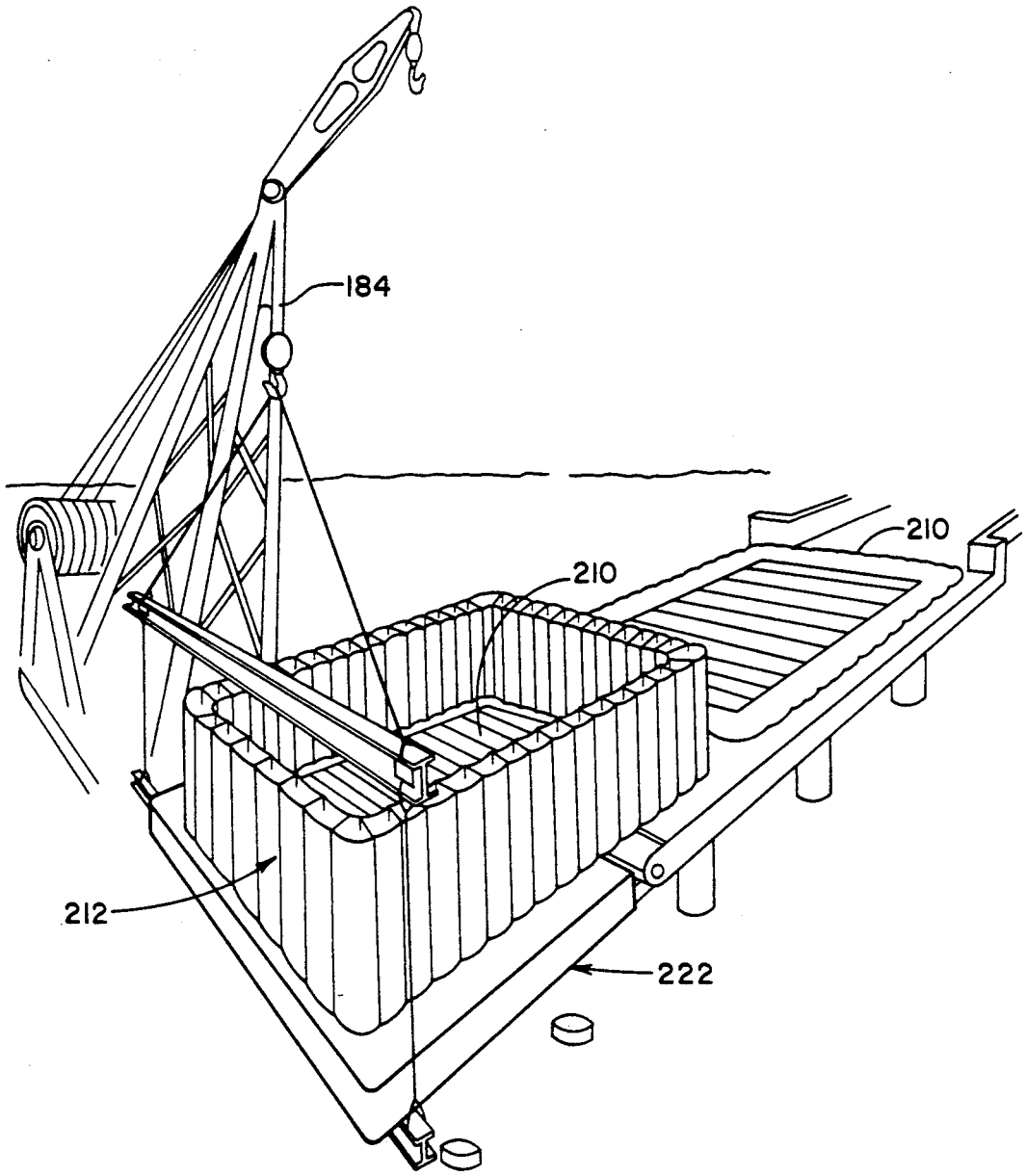
FIG. 36 is a fragmentary pictorial perspective view showing initiation of a step of lowering a completed module from the assembly area of FIGS. 32–35 into the water.
Figure 37:
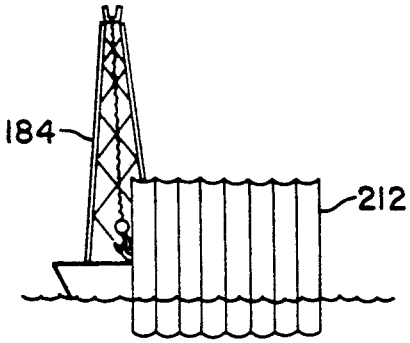
FIGS. 37–41 schematically show successive steps in tilting over the floating module, from the vertical orientation in which it was fabricated and assembled, to a horizontal orientation, for joining in series with others, to provide a vessel midbody.
Figure 38:
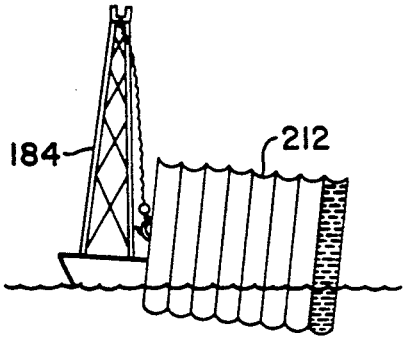
Figure 39:
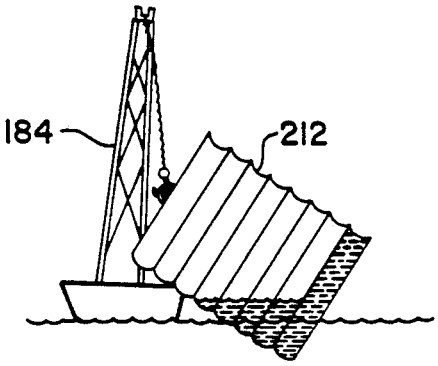
Figure 40:
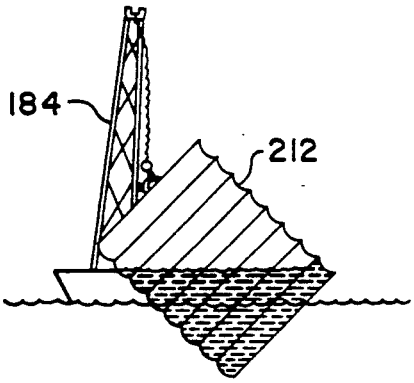

Referring to FIGS. 32–47, this may include providing a bulkhead 210 at a bulkhead assembly area (FIG. 32), assembling a set of module subassemblies 182 vertically about the outer perimeter of the bulkhead 210 and welding the subassemblies 182 to one another and to the bulkhead 210 to create a module 212 (FIGS. 33–35). The completed module 2I2 (shown having a double bottom 214, double side walls 216, a double deck 218 and a double longitudinal vertical intermediate wall 220, wherein the curved plates form the skins and the stiffened flat plates 54 form the longitudinal connectors extending between the ineer and outer hulls) is then guided by the crane 184 into the water, by temporarily lowering the support from under the topside bulkhead assembly area 222, and floating the module away (FIG. 31).

Figure 41:
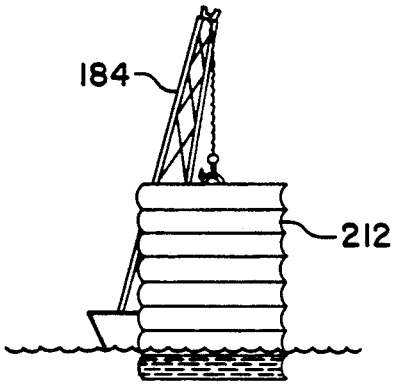
Figure 42:
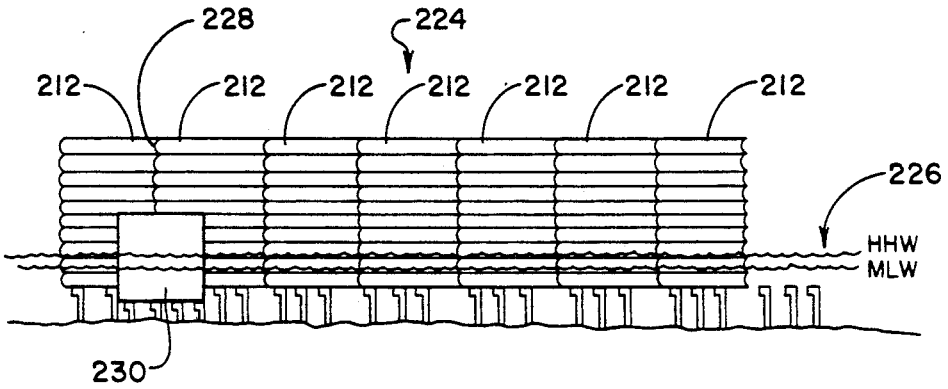
FIGS. 42 and 43 are, respectively, fragmentary side elevational and top plan views of a facility in which modules are successively joined to create a vessel midbody.
Figure 43:
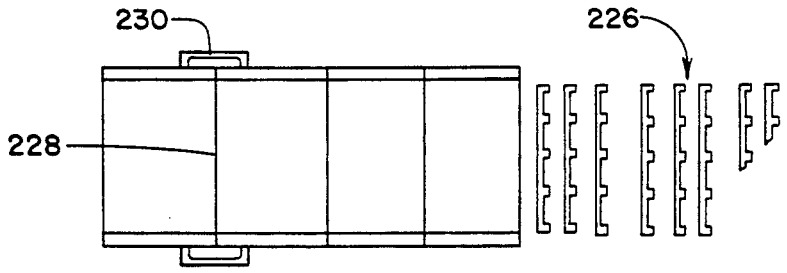
Figure 44:
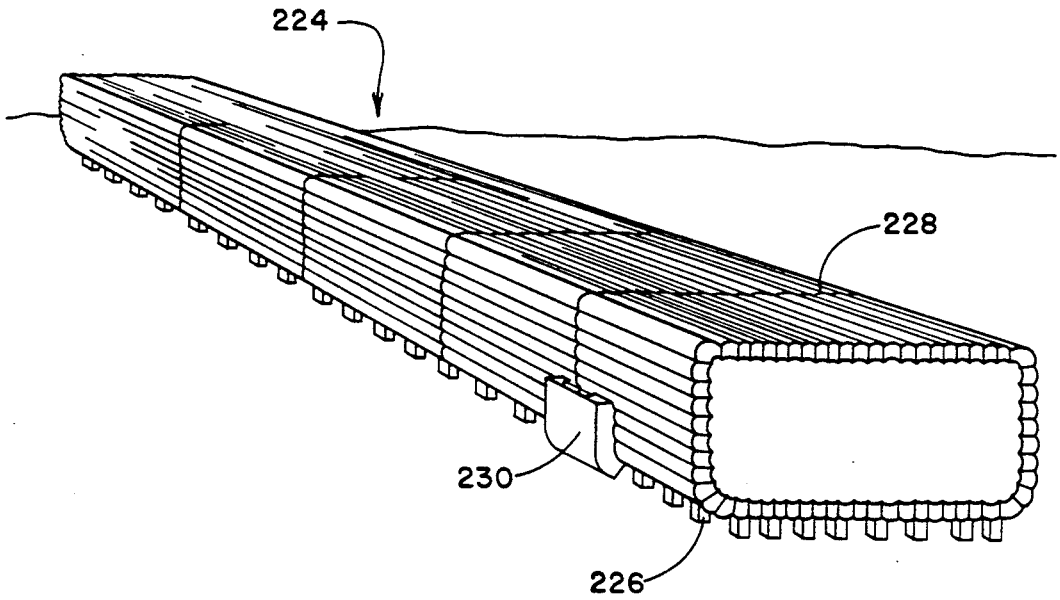
FIG. 44 is a diagrammatic perspective view thereof (with the water omitted)
Figure 45:
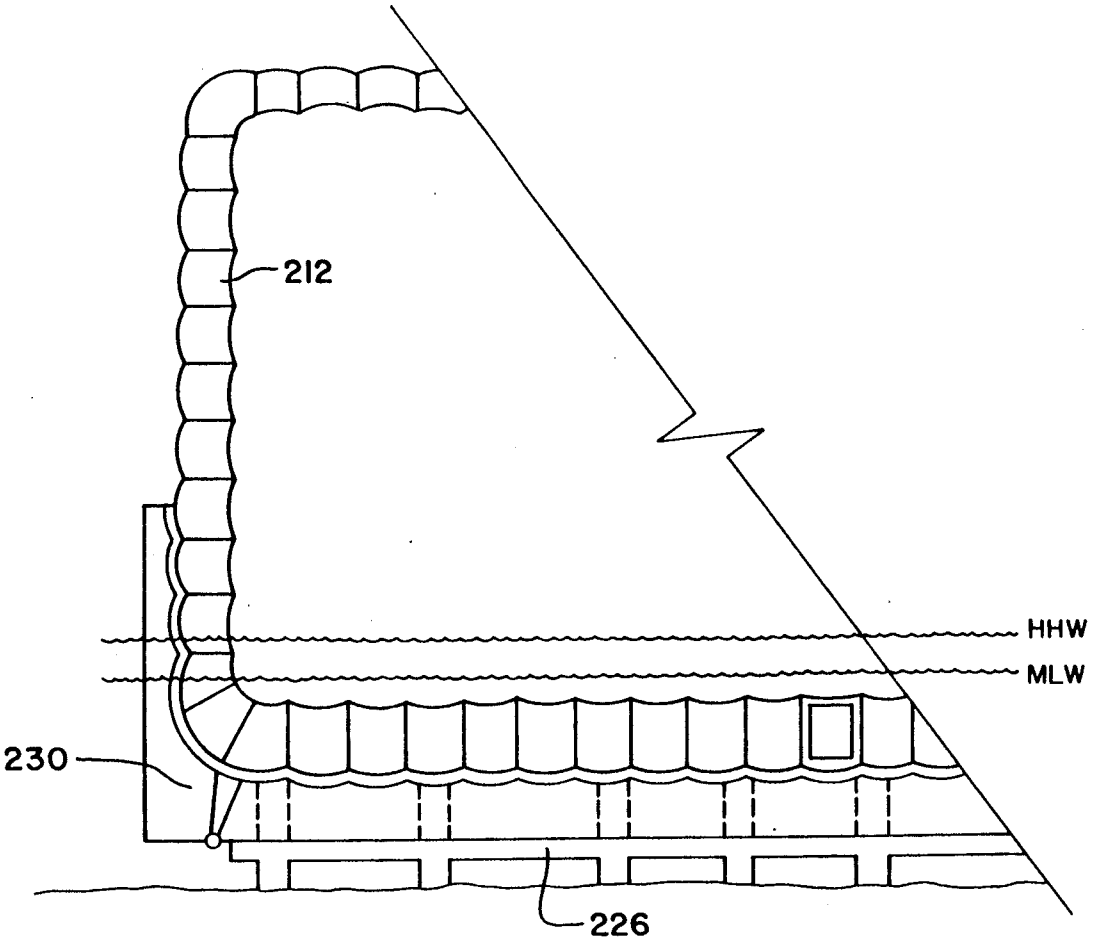
FIG. 45 is a larger scale fragmentary vertical transverse sectional view of the facility of FIGS. 42–44, at the location where one end of one module is being welded to an abutting end of a previously placed module.
Figure 46:
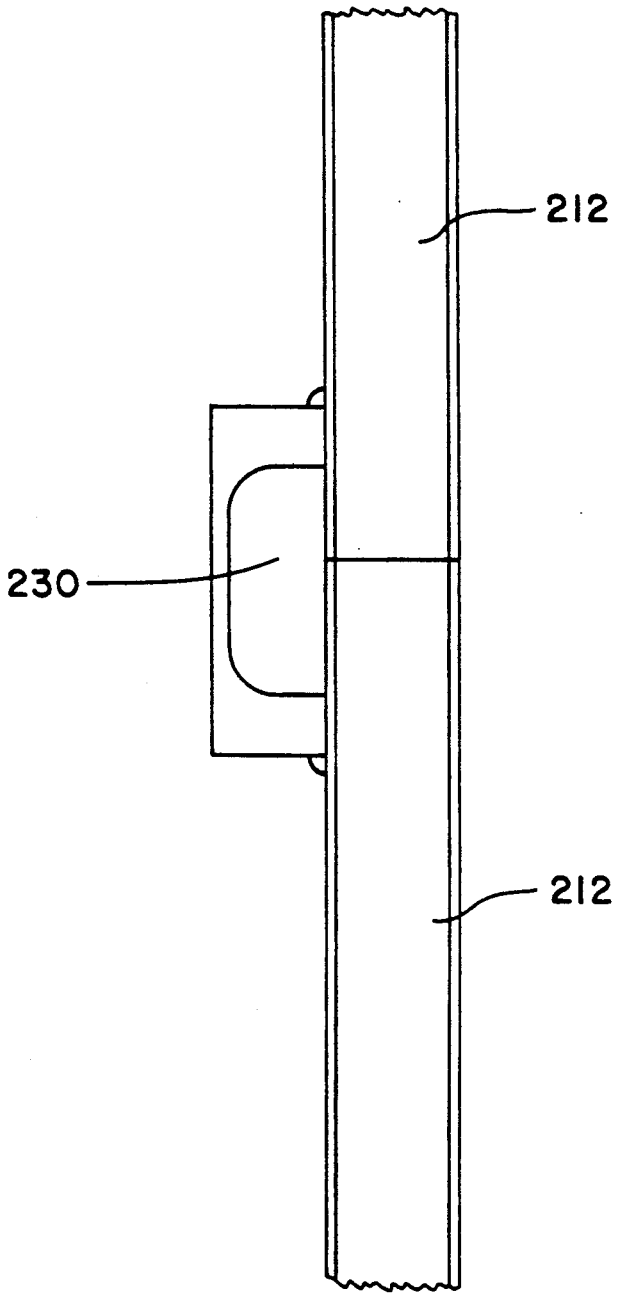
FIG. 46 is a fragmentary top plan view of the left side of the structure shown in FIG. 45.
Figure 47:
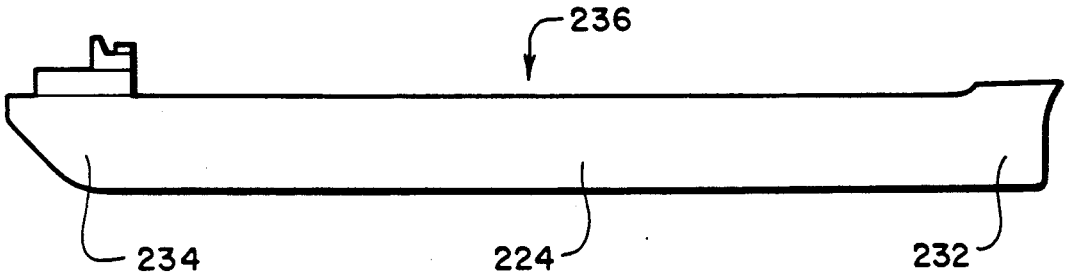
FIG. 47 is a side elevational view of a VLCC having a midbody constructed in accordance with the principles of the present invention, conventionally joined with a conventional bow section and stern section.

In the series of steps depicted in FIGS. 37–41, after damming open ends of cells 160 that will become submerged, certain cells are progressively partly flooded, while the crane 184 guides the module 212 as it rolls from its vertical position (FIG. 37), to a horizontal position (FIG. 41).

Then, the now-horizontal module 212 is floated to the end of a longitudinal midbody assembly 224 (FIGS. 42–46) that is partly submerged, at an intertidal location. The partially complete midbody 224 is shifted longitudinally along the longitudinal midbody assembly facility 226 until its growth end 228 is located over a joining area 230. The next horizontal module 212 is then floated into place, end-to-end with the midbody 224 with the abutting ends located in the joining area 230. Water is then excluded from the joining area and the module 212 is welded to the growth end of the midbody 224. These incremental growth steps are repeated until the midbody 224 is of the desired length. The midbody 224 may be conventionally joined to a bow section 232 and a stern section 234 of a VLCC to provide a vessel 236 having a double-hulled longitudinal midbody.

It should now be apparent that the vessel hull construction and method as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for fabricating a module structure for a double-hulled vessel, comprising:

(a) providing a plurality of flat plate panels, each being elongated rectangular in outer perimetrical shape so as to have two opposite side edges, two opposite end edges, and two opposite flat faces;

(b) providing a plurality of curved plate panels, each being elongated rectangular in outer perimetrical shape so as to have two opposite side edges, two opposite end edges and two opposite correspondingly generally cylindrically arcuately curved faces, so that each curved plate panel is concave in one direction and convex in an opposite direction about an axis parallel to said side edges;

(c) mounting a longitudinally extending series of transversally extending stiffener plates to at least one face of each flat plate panel, so as to provide a plurality of stiffened flat plate panels;

(d) providing each curved plate panel and each stiffened flat plate panel with an all-over, cured coating of paint to provide respective painted panels;

(e) providing a fixture as an array of upstanding towers fixed on a foundation;

(f) vertically disposing in said fixture, among said towers, a first plurality of said painted curved plate panels, arranged in a first series, in which individual ones of these panels spacedly adjoin one another, side edge to side edge, with respective gaps between them, in a single layer;

(g) vertically disposing in said fixture, among said towers, a second plurality of said painted curved plate panels, arranged in a second series, in which individual ones of these panels spacedly adjoin one another side edge to side edge, with respective gaps between them, in a single layer, so that gaps between panels in said second series are substantially in registry with gaps between panels in said first series, thicknesswise of said fixture;

(h) vertically disposing in said fixture a plurality of said painted stiffened flat plate panels arranged in a series, in which one side edge of each painted stiffened flat plate panel adjoins a respective said gap in said first series of painted curved plate panels and an opposite side edge thereof adjoins a respective said gap in each said second series of painted curved plate panels;

(i) supporting said panels in each of said series of panels with respect to respective ones of said towers of said fixture;

(j) welding joints between and among respective ones of said panel side edges in respective ones of said gaps, thereby filling said gaps and uniting said panels in said fixture into a double-hull module subassembly having a plurality of longitudinally extending cells of generally rectangular transverse cross-sectional shape and two laterally opposite ends where side edges of respective terminal ones of said painted curved plate panels are available;

(k) removing support of said fixture from said panels of said subassembly and removing said subassembly from said fixture; and (l) repairing damage caused in step (j) to said cured coating of paint both externally of said subassembly and internally of said cells, at internal corners of respective ones of said cells.

2. The method of claim I, further comprising:

(m) replicating steps (a)–(l) to provide a plurality of said subassemblies; and (n) weldingly joining a plurality of said subassemblies, at respective said side edges of respective terminal ones of said painted curved plate panels, to thereby provide a laterally continuous, tubular module having two longitudinally opposite ends.

3. The method of claim 2, wherein:

step (n) further includes providing a transversally extending bulkhead and weldingly assembling each subassembly, at one end thereof, perimetrically around said bulkhead while weldingly joining said subassemblies to one another, so that each module has a transverse bulkhead provided at one end thereof.

4. The method of claim 3, further including:

(o) replicating steps (m) and (n) to provide a plurality of modules, each having a transverse bulkhead provided at one end thereof; and (p) weldingly joining a succession of said modules to one another end to end in a longitudinally extending series, to thereby provide a double-hulled tanker longitudinal midbody having two opposite ends.

5. The method of claim 4, further including:

joining a vessel bow section to one end of said longitudinal midbody and a vessel stern section to an opposite end of said longitudinal midbody, to thereby provide a double-hulled vessel.

6. The method of claim 1, wherein:

step (a) comprises providing a plurality of raw flat plates of steel, and flame-cutting said plates to edge-trim them and thereby provide said flat plate panels.

7. The method of claim 1, wherein:

step (b) comprises providing a plurality of raw flat plates of steel, bending said raw flat plates about a longitudinal axis to provide curvature thereto, and flame-cutting the resultingly curved raw plates to edge-trim them and thereby provide said curved plate panels.

8. The method of claim 6, wherein:

as a precursor to step (c) each face of a flat plate panel which is to have at least one stiffener plate mounted thereto is cleaned in a respective path extending transversally along each such face; and in step (c), a respective stiffener plate is welded edgewise onto a respective said face of a respective said flat plate panel, on a respective said cleaned path.

9. The method of claim 8, wherein:

each said cleaned path is provided by grinding a respective band of the respective said face of the respective said flat plate panel.

10. The method of claim 7, wherein:

in step (b), said bending is accomplished by coordinately pressing each respective raw flat plate against a convex die using a plurality of coordinatingly moved concavely curved press platens.

11. The method of claim 7, wherein:

as a precursor to step (c) each face of a flat plate panel which is to have at least one stiffener plate mounted thereto is cleaned in a respective path extending transversally along each such face;

in step (c), a respective stiffener plate is welded edgewise onto a respective said face of a respective said flat plate panel, on a respective said cleaned path;

each said cleaned path is provided by grinding a respective band of the respective said face of the respective said flat plate panel; and in step (b), said bending is accomplished by coordinately pressing each respective raw flat plate against a convex die using a plurality of coordinatingly moved concavely curved press platens.

12. The method of claim 11, further comprising:

(m) replicating steps (a)–(l) to provide a plurality of said subassemblies; and (n) weldingly joining a plurality of said subassemblies, at respective said side edges of respective terminal ones of said painted curved plate panels, to thereby provide a laterally continuous, tubular module having two longitudinally opposite ends.

13. The method of claim 12, wherein:

step (n) further includes providing a transversally extending bulkhead and weldingly assembling each subassembly, at one end thereof, perimetrically around said bulkhead while weldingly joining said subassemblies to one another, so that each module has a transverse bulkhead provided at one end thereof.

14. The method of claim 13, wherein:

(o) replicating steps (m) and (n) to provide a plurality of modules, each having a transverse bulkhead provided at one end thereof; and (p) weldingly joining a succession of said modules to one another end to end in a longitudinally extending series, to thereby provide a double-hulled tanker longitudinal midbody having two opposite ends.

15. The method of claim 14, wherein:

joining a vessel bow section to one end of said longitudinal midbody and a vessel stern section to an opposite end of said longitudinal midbody, to thereby provide a double-hulled vessel.

16. The method of claim 1, wherein:

step (i) comprises jacking against and locking portions of respective ones of said panel faces with jacking elements mounted to said towers.

17. The method of claim 1, wherein:

step (j) comprises electrogas welding said joints using an upwardly traveling welding head while supporting respective panel edge margins at each respective gap, while welding the respective joint, using a plurality of backing bars pressed into respective gap corners.

18. The method of claim 17, wherein:

said backing bars are releasably pressed into respective gap corners by supporting each backing bar from a respective said tower using a laterally reversibly expansible support device.

19. The method of claim 18, wherein:

each laterally reversibly expansible support device is releasably pressed into a respective gap corner by internally fluid-pressurizing a resilient-walled chamber thereof.

20. The method of claim 1, wherein:

in step (d), each said panel is cleaned and then cathodically coated with epoxy paint.

21. The method of claim 20, wherein:

said epoxy paint is cathodically coated onto said cleaned panels from a bath containing particles of said paint, in which each said cleaned panel is immersed at least once, followed by being subjected to a paintcuring treatment at least once.

22. A subassembly produced by the process of claim 1.

23. A module produced by the process of claim 2.

24. A longitudinal midbody produced by the process of claim 4.

25. A double-hulled vessel produced by the process of claim 5.

26. A subassembly produced by the process of claim 11.

27. A module produced by the process of claim 12.

28. A longitudinal midbody produced by the process of claim 14.

29. A double-hulled vessel produced by the process of claim 15.

* * * * *